US009467760B2

(12) United States Patent
Kawakami et al.

(10) Patent No.: US 9,467,760 B2
(45) Date of Patent: Oct. 11, 2016

(54) MICROPHONE DEVICE, MICROPHONE UNIT, MICROPHONE STRUCTURE, AND ELECTRONIC EQUIPMENT USING THESE

(71) Applicant: Tomoegawa Co., Ltd., Tokyo (JP)

(72) Inventors: Fukushi Kawakami, Hamamatsu (JP); Takayuki Sano, Shizuoka (JP)

(73) Assignee: TOMOEGAWA CO., LTD., Tokyo (JP)

( * ) Notice: Subject to any disclaimer, the term of this patent is extended or adjusted under 35 U.S.C. 154(b) by 0 days.

(21) Appl. No.: 14/386,249

(22) PCT Filed: Mar. 15, 2013

(86) PCT No.: PCT/JP2013/057432
§ 371 (c)(1),
(2) Date: Sep. 18, 2014

(87) PCT Pub. No.: WO2013/141158
PCT Pub. Date: Sep. 26, 2013

(65) Prior Publication Data

US 2015/0078568 A1 Mar. 19, 2015

(30) Foreign Application Priority Data

Mar. 21, 2012 (JP) ..... 2012-063964
Mar. 21, 2012 (JP) ..... 2012-064342

(51) Int. Cl.
*H04R 1/08* (2006.01)
*H04R 31/00* (2006.01)

(52) U.S. Cl.
CPC ..... *H04R 1/086* (2013.01); *H04R 31/00* (2013.01); *H04R 2410/07* (2013.01); *H04R 2499/11* (2013.01)

(58) Field of Classification Search
CPC ..... H04R 1/023; H04R 1/08; H04R 1/083; H04R 1/086; H04R 1/12; H04R 1/2876; H04R 25/65–25/658; H04R 2410/07; H04R 2499/11
See application file for complete search history.

(56) References Cited

U.S. PATENT DOCUMENTS 2,200,097 A * 5/1940 Phelps ..... H04R 1/086 181/242
4,887,693 A * 12/1989 Plice ..... H04R 1/086 181/125
5,349,140 A * 9/1994 Valenzin ..... H04R 1/086 181/158
5,442,713 A * 8/1995 Patel ..... H04R 1/086 379/431

(Continued)

FOREIGN PATENT DOCUMENTS

JP 06-078040 3/1994
JP 2001-193330 7/2001

(Continued)

*Primary Examiner* — Curtis Kuntz
*Assistant Examiner* — Joshua Kaufman
(74) *Attorney, Agent, or Firm* — Norris McLaughlin & Marcus, P.A.

(57) ABSTRACT

A microphone unit which can suppress collection of wind noise and minimize or eliminate digital signal processing has at least a microphone, a first acoustic transmissive material, and a second acoustic transmissive material, the first acoustic transmissive material is a fiber material in which fibers are intertwined with each other, the second acoustic transmissive material is a mesh-like member or a porous member having a plurality of holes, and the microphone is configured to be protected by the first acoustic transmissive material and the second acoustic transmissive material in this order.

25 Claims, 12 Drawing Sheets

(56) References Cited

U.S. PATENT DOCUMENTS 6,151,399 A * 11/2000 Killion ..... H04R 1/38 381/313
6,671,381 B1 * 12/2003 Lux-Wellenhof ..... H04R 25/70 381/325
2005/0220448 A1 * 10/2005 Tei ..... G03B 17/08 396/25
2005/0271233 A1 * 12/2005 Uchimura ..... H04R 1/086 381/359
2006/0072777 A1 4/2006 Ohashi et al.
2006/0109990 A1 5/2006 Akino
2006/0109996 A1 * 5/2006 Larson ..... H04N 7/18 381/365
2006/0177085 A1 * 8/2006 Izuchi ..... H04R 1/086 381/369
2007/0092097 A1 * 4/2007 Williams ..... H04R 1/023 381/355
2008/0273108 A1 * 11/2008 Tsutsumi ..... H04R 5/2251 348/333.01
2009/0046882 A1 * 2/2009 Sakurai ..... H04R 1/083 381/359
2009/0320979 A1 12/2009 Keleny et al.
2010/0208930 A1 * 8/2010 Kopnov ..... H04M 1/035 381/359
2010/0270102 A1 * 10/2010 Banter ..... H04R 1/023 181/198
2011/0255728 A1 * 10/2011 Abe ..... H04M 1/03 381/355
2012/0033831 A1 * 2/2012 Leitner ..... H04R 1/083 381/98
2014/0140558 A1 * 5/2014 Kwong ..... H04R 3/007 381/345
2015/0078568 A1 * 3/2015 Kawakami ..... H04R 1/086 381/71.1
2015/0304754 A1 * 10/2015 Akino ..... H04R 1/028 381/359

FOREIGN PATENT DOCUMENTS

JP 2005-354581 12/2005
JP 2006-157086 6/2006
JP 2006-295272 10/2006
JP 2010-157964 7/2010
JP 2010-187186 8/2010

* cited by examiner

MICROPHONE DEVICE, MICROPHONE UNIT, MICROPHONE STRUCTURE, AND ELECTRONIC EQUIPMENT USING THESE

BACKGROUND OF THE INVENTION

The present invention relates to a microphone device, a microphone structure, and electronics using them.

More specifically, the present invention relates to a microphone unit and a microphone structure with reduced wind whistling sound and wind noise. The invention relates particularly to an application built in AV/IT equipment such as a video camera and a cell phone.

In electronics such as a camera, a video camera, and a cell phone collecting sound by a microphone device incorporated in an equipment body, noise (wind noise) derived from wind generated near a microphone, human breath, and so on is collected.

Thus, various techniques for suppressing collection of wind noise have been disclosed.

For example, JP 2010-157964 A discloses a technique of applying digital signal processing to an audio signal collected by a microphone device to reduce wind noise from input voice.

Further, JP 2005-354581 A discloses a technique of mounting a microphone and a microphone cover through an elastic member to suppress sound generated in electronics such as a video camera and vibration and noise transmitted through a housing of the electronics.

Other background art is JP 2001-193330 A.

More specifically, a conventional windshield for a microphone is called a windscreen or the like, and many of the windshields have a structure filled with a porous material such as urethane or are in the form of foaming a vinyl or plastic material. Those windshields are provided around a microphone to prevent wind whistling sound. In those windshields, there have been sometimes found ones which intend to exhibit waterproof property only during an interim period by applying processing, such as water-resistant coating and waterproof spray, onto a surface of a constituent material.

Recently, AV/IT equipment has been rapidly developed, equipment used outdoors like a video camera and equipment that collects sound near a human face like a cellular phone are in widespread use, and there are a lot of AV/IT equipment having a miniaturized microphone unit built-in. Since the AV/IT equipment collects wind generated near a microphone and noise (wind noise) derived from human breath or the like, a countermeasure thereof is required; however, when the above-described porous material or foaming material is used, the microphone unit itself becomes large in size, and thus it is not realistic. Thus, noise is eliminated (attenuation/lack of the relevant sound area) by applying digital signal processing to a collected audio signal.

SUMMARY OF THE INVENTION

However, according to a technique of suppressing collection of wind noise by such electrical processing as digital signal processing, a signal processing circuit concerned is required, so that the cost is increased.

According to the technique of suppressing vibration and noise through an elastic member, although it is effective for vibration transmitted through an individual such as a housing, it is difficult to effectively prevent collection of wind noise transmitted through air.

In view of the above technological background, the present invention provides a microphone device, which can suppress collection of wind noise independently of electric signal processing, and electronics using the microphone device.

More specifically, in digital signal processing for elimination of wind noise, it is technically impossible to selectively eliminate only wind noise, and therefore, a method of limiting (attenuating) input in a band region presumed to be wind noise is generally used. Since the band region of wind noise includes a human voice band or approximates this, it is hard to listen to voice recorded under voice input limit for eliminating wind noise, the voice is entirely indistinct, or the sound quality is deteriorated accompanying disturbance of phase of a voice waveform or the like. Thus, an object of the present invention is to provide a microphone unit which can suppress collection of wind noise and minimize or eliminate digital signal processing.

In order to solve the above problem, a microphone device of the present invention (1-1) has a housing having a microphone installation chamber opening outward, a microphone stored in a microphone installation chamber, a cover member having a large number of through holes and covering the microphone installation chamber, and an acoustic transmission member partitioning the microphone installation chamber into a first space on the cover member side and a second space on the microphone side and, at the same time, transmitting an acoustic component, the acoustic transmission member includes a fiber material obtained by intertwining raw materials, configured to contain fiber, with each other, and the air permeability of the fiber material is less than 0.5 s/100 cm3.

According to the present invention (1-2), in the invention (1-1), the fiber is metal fiber or fluorine fiber.

According to the present invention (1-3), in the invention (1-1) or the invention (1-2), the microphone device further has an elastic member disposed at least one of between the housing and the microphone, between the cover member and the microphone, and between the acoustic transmission member and the microphone and attenuating or blocking vibration transmitted to the microphone through the housing, the cover member, or the acoustic transmission member.

In order to solve the above problem, electronics of the present invention (1-4) is mounted with the microphone device according to any one of the inventions (1-1) to (1-3).

According to the present invention (1-4), in the invention (3), the electronics is an imaging device in a form in which a photographer holds a device housing set to a horizontal direction with one hand, and the microphone device is disposed on the photographer side relative to a holding position of the device housing.

The present invention (2) provides a microphone unit having at least a microphone, a first acoustic transmissive material, and a second acoustic transmissive material, the first acoustic transmissive material is a fiber material in which fibers are intertwined with each other, the second acoustic transmissive material is a mesh-like member or a porous member having a plurality of holes, and the microphone is configured to be protected by the first acoustic transmissive material and the second acoustic transmissive material in this order.

According to the present invention, wind noise is attenuated by a cover member and an acoustic transmission member, and collection of the wind noise can be suppressed independently of electric signal processing.

When an elastic member is used, collection of noise such as sound generated in equipment and vibration can be suppressed.

Namely, the present invention can provide a microphone unit which can suppress the collection of wind noise and minimize and eliminate the digital signal processing.

BRIEF DESCRIPTION OF THE DRAWINGS

FIG. 1 is a perspective view showing a video camera as an example of electronics of the present invention having a microphone device according to one embodiment (first embodiment) of the present invention built-in.

FIG. 8 is a perspective view showing a video camera as a variation of electronics of the present invention having the microphone device according to one embodiment (first embodiment) of the present invention built-in.

FIG. 9 is a perspective view showing a video camera as another variation of electronics of the present invention having the microphone device according to one embodiment (first embodiment) of the present invention built-in.

DETAILED DESCRIPTION OF THE INVENTION

First Embodiment

Figure 1:
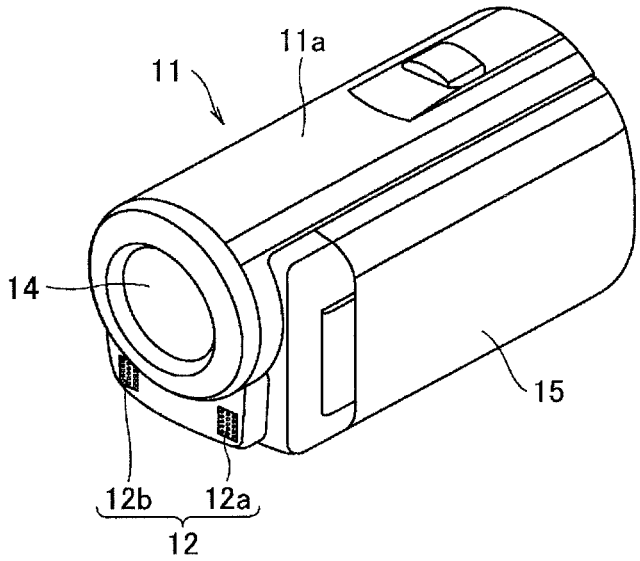

Hereinafter, an embodiment as an example of the present invention will be described in detail based on drawings. However, the following embodiments are just examples, and the technical range of the present invention is not limited thereto. In the drawings for explaining the embodiments, the same components are denoted by the same reference numerals in principle, and repetitive explanations thereof are omitted. Hereinafter, although first to sixth embodiments will be described as examples of the present invention, any constitution of the embodiments may be incorporated in any other embodiments. For example, an example in which a component of the first embodiment and a component of the second embodiment are incorporated in the sixth embodiment is a change example of the sixth embodiment.

FIG. 1 is a perspective view showing a video camera 11 (imaging device) as one embodiment of electronics in the present invention as viewed from an obliquely front side.

As shown in FIG. 1, a lens 14 for optically deflecting and converging an image of an object to be imaged is disposed on a front surface of a video camera housing 11*a* (device housing), and an image through the lens 14 is formed on a solid-state imaging element such as a CCD imaging plate and output as a video signal which is an electric signal.

A microphone device 12 used for collecting voice of an image to be imaged while linking with the image is mounted (built in) on both sides under the lens 14 in the video camera housing 11*a*.

A microphone device 12A on the right side of the drawing is disposed to record sound on the left side relative to a photographer, and a microphone device 12*b* on the left side of the drawing is disposed to record sound on the right side relative to the photographer. Accordingly, the recorded sound is stereophonically reproduced as sound of two channels having a sense of presence.

The details of the microphone device 12 will be described later.

In FIG. 1, an opening and closing type monitor portion 15 incorporated with a liquid crystal panel (not shown) is provided at a side portion of the video camera housing 11*a*. A photographer opens the monitor portion 15 while extending in a horizontal direction, adjusts an angle of the monitor portion 15 while tilting the monitor portion 15, and meanwhile takes an image while seeing the liquid crystal panel of the monitor portion 15. The video camera housing 11*a* is further provided with various buttons, lamps, levers, terminals, and so on used in photographing and editing.

Figure 2:
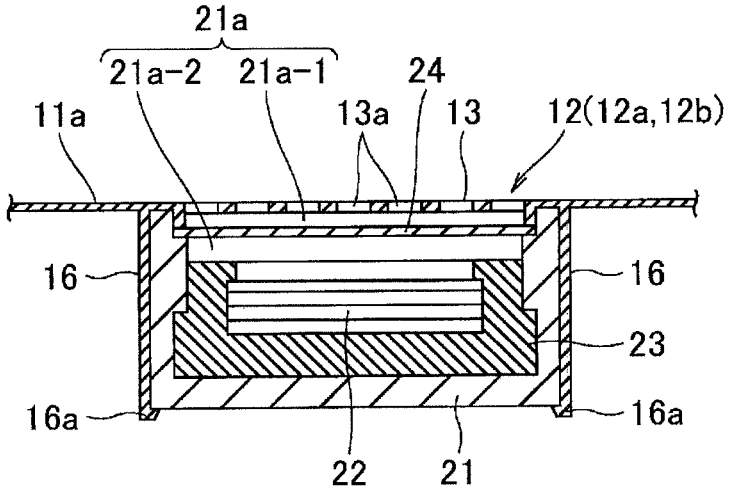
FIG. 2 is a cross-sectional view as an example of the microphone device built in the video camera of FIG. 1.

FIG. 2 is a cross-sectional view of the microphone device 12 mounted in the video camera of the present embodiment having the above constitution.

As shown in FIG. 2, the microphone device 12 has a microphone housing (housing) 21 having a microphone installation chamber 21*a* opening outward. The microphone housing 21 is attached to the inside of the video camera housing 11*a* so that the outer circumference is held by holding protrusions 16 formed inside the video camera housing 11*a*, and the microphone housing 21 is prevented from falling from the holding protrusions 16 by being anchored to fall prevention claws 16*a* each formed at a front end of the holding protrusion 16.

A microphone 22 is stored in the microphone installation chamber 21*a* through an elastic member 23 formed of a rubber-like elastic body such as elastomer.

When the elastic member 23 is disposed between the microphone housing 21 and the microphone 22, vibration transmitted to the microphone 22 through the microphone housing 21 is attenuated (or blocked) by the elastic member 23, so that collection of noise such as sound generated in equipment and vibration is suppressed.

The microphone 22 is constituted of a condenser microphone and a preamplifier for a microphone in this embodiment and connected by wiring (not shown) for transmitting an audio signal from the microphone 22 to a signal processing portion.

However, various types of well-known microphones (such as a moving coil type microphone, a ribbon type microphone, a carbon microphone, and a piezoelectric microphone) may be used as the microphone 22, and the microphone is not limited to the condenser type shown in this embodiment. The microphone 22 may be wirelessly connected to the signal processing portion in a cordless manner.

The microphone installation chamber 21*a* is covered with a cover member 13. The cover member 13 has a shape in which a large number of through holes 13*a* having a square shape, for example, are formed, and the cover member 13 protects the inside from physical impact applied from the outside and, at the same time, can collect external sound through the through holes 13*a*. The cover member 13 is formed of resin to be integrally formed with the video camera housing 11*a* in the present embodiment. However, the cover member 13 may be separated from the video camera housing 11*a*.

The material of the cover member 13 is not particularly limited and may be formed of metal or resin, for example. Further, the shape of the through hole 13*a* is not particularly limited and may be either a round shape or a square shape. Accordingly, the cover member 13 may be formed by forming the through holes 13*a* by knitting wire-like or string-like metal or resin or may be formed by forming the punched through holes 13*a* in a plate-like body. The opening diameter of the through hole 13*a*, the number of the through holes 13*a*, and the opening ratio of the through hole 13*a* are not particularly limited.

The microphone installation chamber 21*a* includes an acoustic transmission member 24 partitioning the microphone installation chamber 21*a* into a first space 21*a*-1 on the cover member 13 side and a second space 21*a*-2 on the microphone 22 side and, at the same time, transmitting an acoustic component (20 to 20 kHz). The acoustic transmission member 24 is fixed by being held between the above-described microphone housing 21 and the video camera housing 11*a* so as to be placed on a step portion formed in an upper portion of the microphone housing 21.

The acoustic transmission member 24 is formed of a fiber material obtained by intertwining raw materials, configured to contain fiber, with each other, and the air permeability of the fiber material is less than 0.5 s/100 cm3. This is because when the air permeability of the fiber material used as the acoustic transmission member 24 is less than 0.5 s/100 cm3, the acoustic transmission member 24 has high acoustic transmissivity. Since the fiber material is obtained by intertwining raw materials, configured to contain fiber, with each other, fibers have such a density that an infinite number of irregular voids are provided, and therefore, wind causative of wind whistling sound is blocked.

Namely, the acoustic transmission member 24 formed of the fiber material functions as a shield or a moving direction converter (flap) to "wind" as movement of a mass of air molecules and provides substantially complete transmissivity to "sound" as movement of pressure change (a medium itself just vibrates and does not move).

Although other members are not required to be used along with the acoustic transmission member 24 when the fiber material itself has a self-standing property (rigidity), the acoustic transmission member 24 may have a constitution in which the fiber material is held between two net-like bodies, for example.

Here, the acoustic transmission member 24 will be described in detail.

As described above, the acoustic transmission member 24 makes the acoustic component (20 to 20 kHz) transmit, and the air permeability of the fiber material constituting the acoustic transmission member 24 is less than 0.5 s/100 cm3. When the acoustic transmission member 24 has the relevant property, the acoustic transmissivity is significantly enhanced. The air permeability means time required for passage of certain air through a certain area under a certain pressure, and in this example means time required for passage of 100 cm3 of air. The air permeability is measured by a Gurley method specified in JIS P8117.

The reason why the air permeability is less than 0.5 s/100 cm3 is because a measurable range in a device used in the measurement of the present application is not less than 0.5 s/100 cm3, and the air permeability of the acoustic transmission member 24 is less than the measurable range.

The acoustic transmission member 24 is obtained by intertwining the raw materials, configured to contain fiber, with each other. For example, a fiber material in which fibers are intertwined with each other is obtained by papermaking by a wet papermaking method. A raw material used in producing of the fiber material is metal fiber or fluorine fiber in the present embodiment. The fiber material used as the acoustic transmission member 24 has a thickness of not more than 3 mm, preferably 10 μm to 2000 μm, more preferably 20 μm to 1500 μm. When the acoustic transmission member 24 has such a thickness, the acoustic transmission member 24 has a certain level of rigidity, and an effective wind whistling sound reduction effect can be obtained by a simple minimum framework.

However, the raw material of the fiber material is not limited to metal fiber or fluorine fiber, and the thickness is not limited to the above numerical values.

Next, a material of metal fiber as a raw material of a fiber material will be described.

When a metal fiber material is produced by wet papermaking, using metal fiber as the acoustic transmission member 24, the metal fiber material is obtained by papermaking slurry configured to contain one or two or more kinds of metal fibers by a wet papermaking method. When the metal fiber material is produced by compression molding, using metal fiber, the metal fiber material is obtained by pressurizing an aggregation of metal fibers under heating. The metal fibers are intertwined with each other in both the cases. Although the shape of the metal fiber material is not particularly limited, it is preferable that the metal fiber material is in a form of a metal fiber sheet.

Hereinafter, the material, structure, and producing method of metal fiber will be described in detail. As the metal fiber material and a method for producing the metal fiber material, the description contents of JP 2000-80591 A, JP 2649768 B1, and JP 2562761 B1 are incorporated in the present specification.

One or two or more kinds of metal fibers as materials of metal fiber are combinations of one or two or more kinds selected from fibers formed of metal materials such as stainless steel, aluminum, brass, copper, titanium, nickel, gold, platinum, and lead.

The metal fiber material has a structure in which metal fibers are intertwined with each other. A fiber diameter of metal fiber constituting the relevant metal fiber is 1 μm to 50 μm, preferably 2 μm to 30 μm, more preferably 8 μm to 20

μm. Such metal fiber is suitable for intertwining metal fibers with each other, and when such metal fibers are intertwined, it is possible to obtain a metal fiber sheet having a surface with little fuzz and having the acoustic transmissivity.

The method for producing the metal fiber material using the wet papermaking method includes a fiber intertwining treatment process of, when slurry configured to contain one or two or more kinds of metal fibers is formed into a sheet by the wet papermaking method, intertwining the metal fiber, forming a moisture-containing sheet on a net, with each other.

As the fiber intertwining treatment process, it is preferable to employ, for example, a fiber intertwining treatment process of jetting a high-pressure water jet against a metal fiber sheet surface after papermaking. More specifically, a plurality of nozzles are arranged in a direction perpendicular to a sheet flow direction, and the high-pressure water jets are jetted from the nozzles simultaneously, whereby metal fibers can be intertwined with each other throughout the sheet. Namely, in a sheet formed of metal fibers irregularly intersecting in a planar direction by wet papermaking, when the high-pressure water jet is jetted in a Z-axis direction of the sheet, for example, the metal fibers corresponding to a portion jetted with the high-pressure water jet are oriented in the Z-axis direction. The metal fibers oriented in the Z-axis direction are entangled between metal fibers irregularly oriented in the planar direction, and physical strength can be obtained in such a state that fibers are three-dimensionally entangled with each other, that is, by intertwining the fibers.

As the papermaking method, various methods such as fourdrinier papermaking, cylinder mold papermaking, and inclined wire type papermaking can be employed as necessary. When slurry including long metal fiber is produced, the dispersibility of the metal fibers in water may be deteriorated, and therefore, a small amount of a polymer aqueous solution having a thickening effect, such as polyvinylpyrrolidone, polyvinyl alcohol, and carboxymethyl cellulose (CMC), may be added.

In a method for producing a metal fiber material using compression molding, fibers are first bundled to be preliminarily compressed, for example, and thus to form a web. Alternatively, a binder is impregnated between fibers to add a binding between the fibers and thereafter preliminarily compressed, for example. After that, an aggregation of metal fibers is pressurized while being heated to form a metal fiber sheet. Although such a binder is not particularly limited, in addition to an organic binder such as an acrylic-based adhesive, an epoxide-based adhesive, and a urethane-based adhesive, an inorganic adhesive such as colloidal silica, liquid glass, and silicate soda may be used. Instead of impregnation with the binder, a fiber surface is previously coated with a heat adhesive resin, and an aggregation of metal fibers may be stacked, and then heated and adhered. The amount of impregnation of the binder is preferably 5 to 130 g with respect to a sheet surface weight of 1000 g/m$^2$, and more preferably 20 to 70 g.

The aggregation of the metal fibers is pressurized while being heated, whereby a sheet is formed. Although the heating conditions are set considering the drying temperatures and curing temperatures of the binder in use and a heat adhesive resin, the heating temperature is usually approximately 50 to 1000° C. The pressure to be added is adjusted considering the elasticity of fiber, the thickness of the sound transmission member 24, and the light transmittance of the sound transmission member 24. When the fibers are impregnated with the binder by spraying, it is preferable that a metal fiber layer is formed to have a predetermined thickness by press working and so on before the spray treatment.

It is preferable that the method for producing a metal fiber material includes, after the wet papermaking process described above, a sintering process of sintering the obtained metal fiber material in vacuum or in a non-oxidative atmosphere at a temperature not more than the melting point of the metal fiber (in the compression molding, warming and pressurization replace the sintering process). Namely, when the sintering processing is performed after the wet papermaking process described above, fiber intertwining treatment is applied, and therefore, an organic binder or the like is not required to be added to the metal fiber material. Therefore, cracked gas of the organic binder or the like does not hinder the sintering process, and a metal fiber material having a gross surface peculiar to metal can be produced. Since metal fibers are intertwined, the strength of the metal fiber material after sintering can be further enhanced. By virtue of the sintering of the metal fiber material, the metal fiber material exhibiting high acoustic transmissivity and highly resistant to water is obtained. When the metal fiber material is not sintered, remaining macromolecules having a thickening effect absorb water, so that resistance to water may be deteriorated.

Next, the material of fluorine fiber as a raw material of a fiber material will be described.

When fluorine fiber is used as fiber, a fluorine fiber material is constituted of a short fiber-like fluorine fiber oriented in irregular directions and is a material (paper) bonded between the fluorine fibers by thermal fusion bonding.

Hereinafter, a material of fluorine fiber and a method for producing fluorine fiber will be described in detail. As the material of fluorine fiber and the method for producing fluorine fiber, the description contents of JP 63-165598 A is incorporated in the present specification.

The fluorine fiber is produced from a thermoplastic fluororesin, and the main components include polytetrafluoroethylene (PTFE), tetrafluoroethylene (TFE), perfluoroether (PFE), a copolymer of tetrafluoroethylene and hexafluoropropylene (FEP), a copolymer of tetrafluoroethylene and ethylene or propylene (ETFE), a polyvinylidene fluoride resin (PVDF), a polychlorotrifluoroethylene resin (PCTFE), and polyvinyl fluoride resin (PVF). However, the main component is not limited thereto as long as it is formed of fluororesin and may be used by being mixed with those resins or other resins. In the fluorine fiber, in order to obtain paper-like fiber by the wet papermaking method, the fluorine fiber is preferably single fiber having a fiber length of 1 to 20 mm, and the fiber diameter is preferably 2 to 30 μm.

In the production of the fluorine fiber material, the fluorine fibers and a material having a self-adhesive function are mixed by the wet papermaking method and dried to obtain a fluorine fiber mixed paper material. The fluorine fiber mixed paper material is thermally compressed at a temperature of not less than a softening point of the fluorine fiber to heat seal between fibers of the fluorine fiber. Thereafter, the material having a self-adhesive function is dissolved and removed by a solvent and dried again if necessary, whereby the sound transmission material can be produced.

As the material having a self-adhesive function, there may be used natural pulp made from a plant fiber such as wood, cotton, hemp, and straw usually used in the manufacture of paper, synthetic pulp and synthetic fiber made from polyvinyl alcohol (PVA), polyester, aromatic polyamide, and acrylic or polyolefin thermoplastic synthetic polymer, and a paper strengthening agent for papermaking made from natural polymer or synthetic polymer. The material is not limited to them as long as it has a self-adhesive function, is mixed with fluorine fiber, and can be dispersed in water.

Next, in a fluorine fiber sheet (fluorine fiber material) and a metal fiber sheet (metal fiber material) as the above-described acoustic transmission member 24, a specific producing example of an obtained sheet will be described. In the present application, the following sheets can be used as the acoustic transmission member 24, for example. However, those sheets are just examples, the acoustic transmission member of the present invention includes a fiber material obtained by papermaking a raw material configured to contain fiber by the wet papermaking method, it is sufficient that the air permeability of the fiber material is less than 0.5 s/100 cm3, and the acoustic transmission member of the present invention is not limited to those examples.

(1) Production Example 1

Fluorine Fiber Sheet 80 parts by weight of thermoplastic fluorine fiber (Aflon COP produced by Asahi Glass Co., Ltd., a product of 10 μmϕ×11 mm was used) composed of a copolymer of tetrafluoroethylene and ethylene and 20 parts of NBKP beaten to a beating degree of 40° SR were dispersed and mixed in water, 0.5% of betaine amphoteric surfactant (produced by Daiwa Chemical Industries Co., Ltd., DESUGURAN B was used) was added based on the raw material (for fluorine fiber and pulp, and the same was applied to the following description), and defiberization was performed at a raw material concentration of 0.5% by a stirring machine. After that, 1% of an acrylamide-based dispersant (ACRYPERSE PMP produced by Diafloc Co., Ltd. was used) was added based on the raw material, sheeted by a TAPPI standard sheet machine, and dried, whereby a fluorine fiber mixed paper having a basis weight of 115 g/d was obtained. After that, the fluorine fiber mixed paper was subjected to heating and pressurizing treatment at 220° C. at a pressure of 10 kg/cm$^2$ for 20 minutes, soaked in a 98% $H_2SO_4$ solution at room temperature to solve a pulp portion of the fluorine fiber mixed paper, washed with water, and dried again, whereby a fluorine paper according to the producing example 1 was obtained.

(2) Producing Example 2

Fluorine Fiber Sheet

In the producing example 2, a fluorine paper according to the producing example 2 was obtained in the same manner as in the producing example 1, except that a fluorine paper has a thickness of shown in Table 1, and pressurizing treatment is applied to obtained paper at higher pressure.

(3) Producing Example 3

Metal Fiber Sheet

Slurry composed of 60 parts by weight of stainless steel fiber (trade name: SUSMIC produced by Tokyo Pore MFG. Co., Ltd.) having a fiber length of 4 mm and a fiber diameter of 8 μm, 20 parts by weight of copper fiber (trade name: Caplon produced by Esco Co., Ltd.) having a fiber length of 4 mm and a fiber diameter of 30 μm as fine electroconductive metal, and 20 parts by weight of PVA fiber (Fibribond VPB105-1-3 produced by KURARAY Co., Ltd.) having a solubility of 70° C. in water was dehydrated by pressing and dried under heat by the wet papermaking method, whereby a metallic fiber sheet having a basis weight of 100 g/m$^2$ was obtained. The obtained sheet was then press-bonded while being heated under such conditions of a linear pressure of 300 kg/cm and a rate of 5 m/min, using a heating roller having a surface temperature of 160° C. Then, the press-bonded metallic fiber sheet was subjected to a sintering treatment under conditions of a heat treatment temperature of 1120° C., and a rate of 15 cm/min, using a continuous sintering furnace (brazing furnace with a mesh belt) in a hydrogen gas atmosphere, without pressing the metallic fiber sheet, whereby a metal fiber sintered sheet in a producing example 3 having a basis weight of 80 g/m$^2$ and a density of 1.69 g/cm$^3$, in which the surface of the stainless steel fiber was covered with molten copper.

(4) Producing Example 4

Metal Fiber Sheet

A metal fiber sheet in the producing example 4 was obtained in the same manner as in the producing example 3, except that sintering in the continuous sintering furnace was not performed.

(5) Producing Example 5

Metal Fiber Sheet

Fiber having a wire diameter of 30 μm of stainless steel AISI316L was used, and the fibers were uniformly superposed to form a cotton-like web. The web was weighed so that the weight was 950 g/m$^2$ and compressed between flat plates so that the thickness was 800 μm. The web having a plate shape by compression was put into a sintering furnace to be heated to 1100° C. in a vacuum atmosphere, and, thus, to be sintered, whereby a sample was obtained.

The air permeability, thickness, and acoustic transmissivity of the sheets in the producing examples 1 to 5 are shown in Table 1.

TABLE 1

| Sample | Material | Air permeability (s/100 ml) | Thickness (μm) | Sintering | Acoustic transmissivity |
|---|---|---|---|---|---|
| Producing Example 1 | Fluororesin fiber | 0 | 250 | Yes | ○ |
| Producing Example 2 | Fluororesin fiber | 0 | 33 | Yes | ◎ |
| Producing Example 3 | Stainless steel fiber sheet | 0 | 35 | Yes | ◎ |
| Producing Example 4 | Stainless steel fiber sheet | 0 | 39 | No | ◎ |
| Producing Example 5 | Stainless steel fiber sheet | 0 | 800 | Yes | ◎ |

In table 1, the air permeability was measured by using a Gurley densometer (No. 323 manufactured by YASUDA SEIKI SEISAKUSHO, LTD.) by a Gurley method specified in JIS P8117.

In the acoustic transmissivity (insertion loss), the fiber sheet in each of the producing examples 1 to 4 was installed on a front surface of a sound producing device of about 2250 cm$^3$ to which a speaker having an effective diameter of several tens cm was attached, transmission frequency characteristics measured by a microphone installed at a position of 1500 mm from a front surface of the speaker was measured, and a change thereof was measured. In the speaker, a sine wave sweep which is not frequency modulated was used as a signal from substantially 100 Hz to 10 kHz. In the acoustic transmissivity of Table 1, when the acoustic transmissivity is within 5 dB in each 1/1 octave band, ○ was used, and when the acoustic transmissivity is within 3 dB, ⊙ was used.

In table 1, when the air permeability is 0 s/100 cm3, it means that it is less than 0.5 s/100 cm3.

There will be described sound collecting characteristics of wind noise in the microphone device 12 (FIGS. 1 and 2) which uses the acoustic transmission member 24 including a fiber material thus obtained by intertwining raw materials, configured to contain fiber, with each other and constituted of a sheet in which the air permeability of the relevant fiber material is less than 0.5 s/100 cm3.

Figure 3:
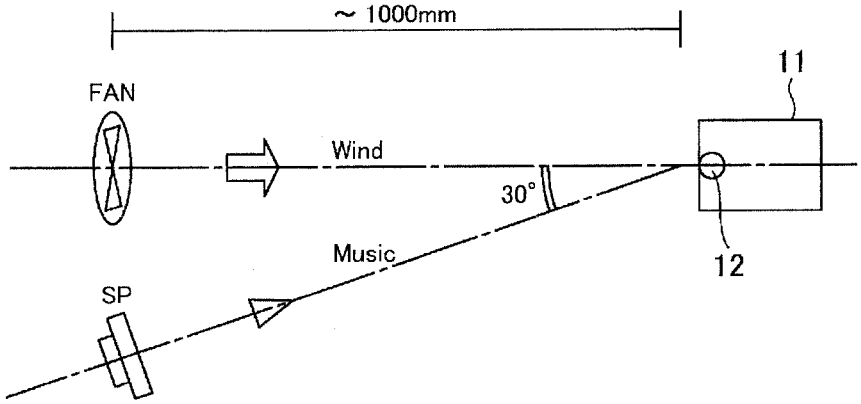
FIG. 3 is a conceptual diagram of a system used in an evaluation test of the microphone device according to one embodiment (first embodiment) of the present invention.

FIG. 3 is a conceptual diagram of a system used in an evaluation test of the sound collecting characteristics. In the evaluation test, in an anechoic room wind with a wind speed of 3.3 m/s (in a range in which generation of the wind whistling sound is confirmed and the reduction of the wind whistling sound can be observed) was sent from a blower (FAN) to the microphone device 12 of the video camera 11 installed at a position apart from the blower by 1000 mm. The wind noise was evaluated by an output response of the microphone device 12 measured when the microphone device 12 has the cover member 13 and the acoustic transmission member 24, when there are neither the cover member 13 nor the acoustic transmission member 24, when only the acoustic transmission member 24 is provided, and when only the cover member 13 is provided.

The speaker was installed to form an angle of about 30° with the blower (FAN) with respect to the video camera 11, voices (sound having an audio frequency band of 20 to 20000 Hz) were sent, and the insertion loss was evaluated similarly.

Figure 4:
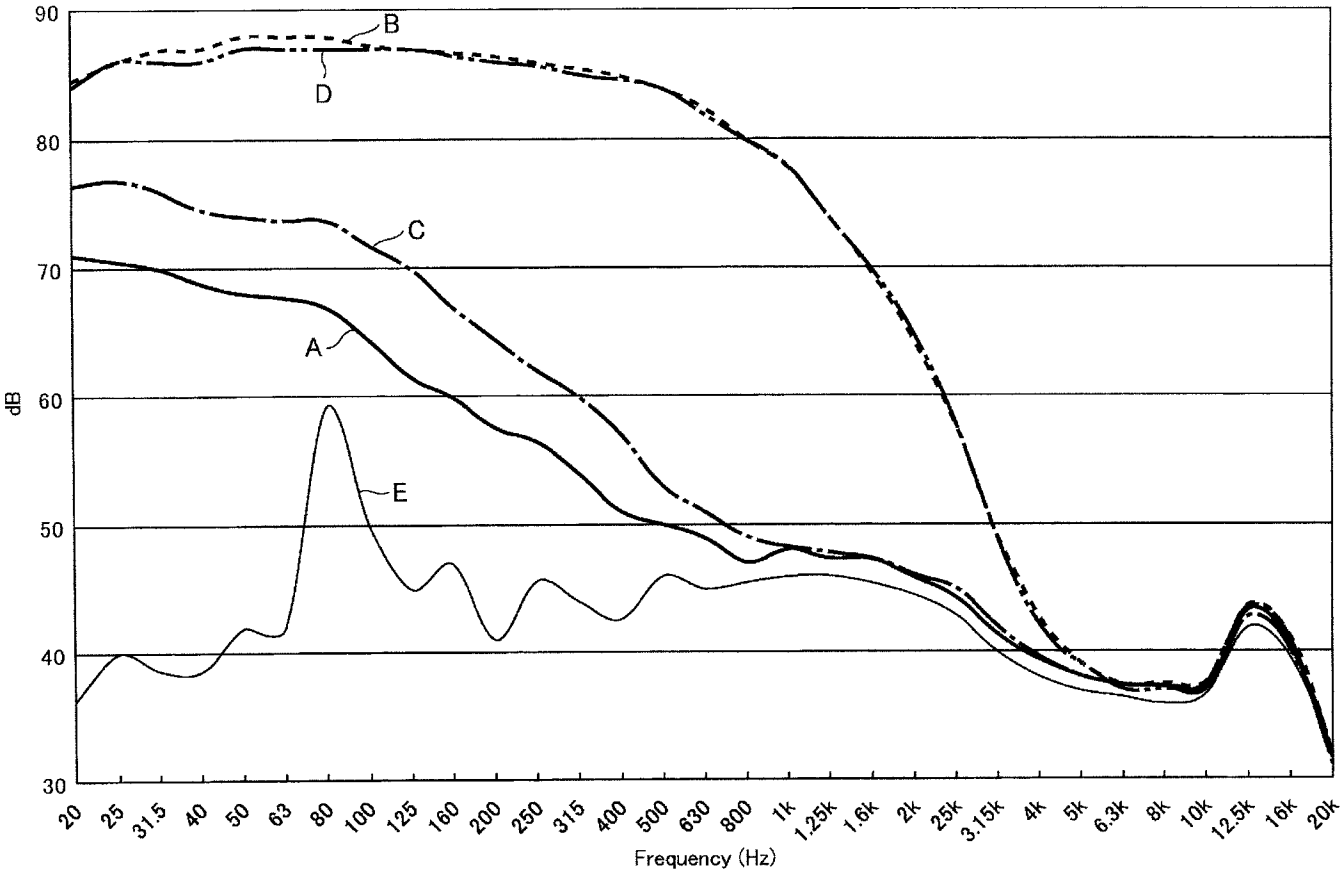
FIG. 4 is a graph showing measurement results of wind noise in the evaluation test of the microphone device according to one embodiment (first embodiment) of the present invention.

The measurement result of wind noise is shown in FIG. 4. In FIG. 4, reference numeral A is output characteristics obtained when both the cover member 13 and the acoustic transmission member 24 are provided, reference numeral B is output characteristics obtained when there are neither the cover member 13 nor the acoustic transmission member 24, reference numeral C is output characteristics obtained when only the acoustic transmission member 24 is provided, reference numeral D is output characteristics obtained when only the cover member 13 is provided, and reference numeral E is output characteristics of motor sound of the blower (measurement limit).

As illustrated, when both the cover member 13 and the acoustic transmission member 24 are provided (A), wind noise was reduced by about 35 dB (500 Hz) compared to the case where there are neither the cover member 13 nor the acoustic transmission member 24 (B). Although a wind noise reduction effect is confirmed also in the case where there is only the acoustic transmission member 24 (C), when the cover member 13 (D) having little to no wind noise reduction effect when used alone and the acoustic transmission member 24 are used together, it can be shown that a significant wind noise reduction effect as appeared in A is confirmed.

Figure 5:
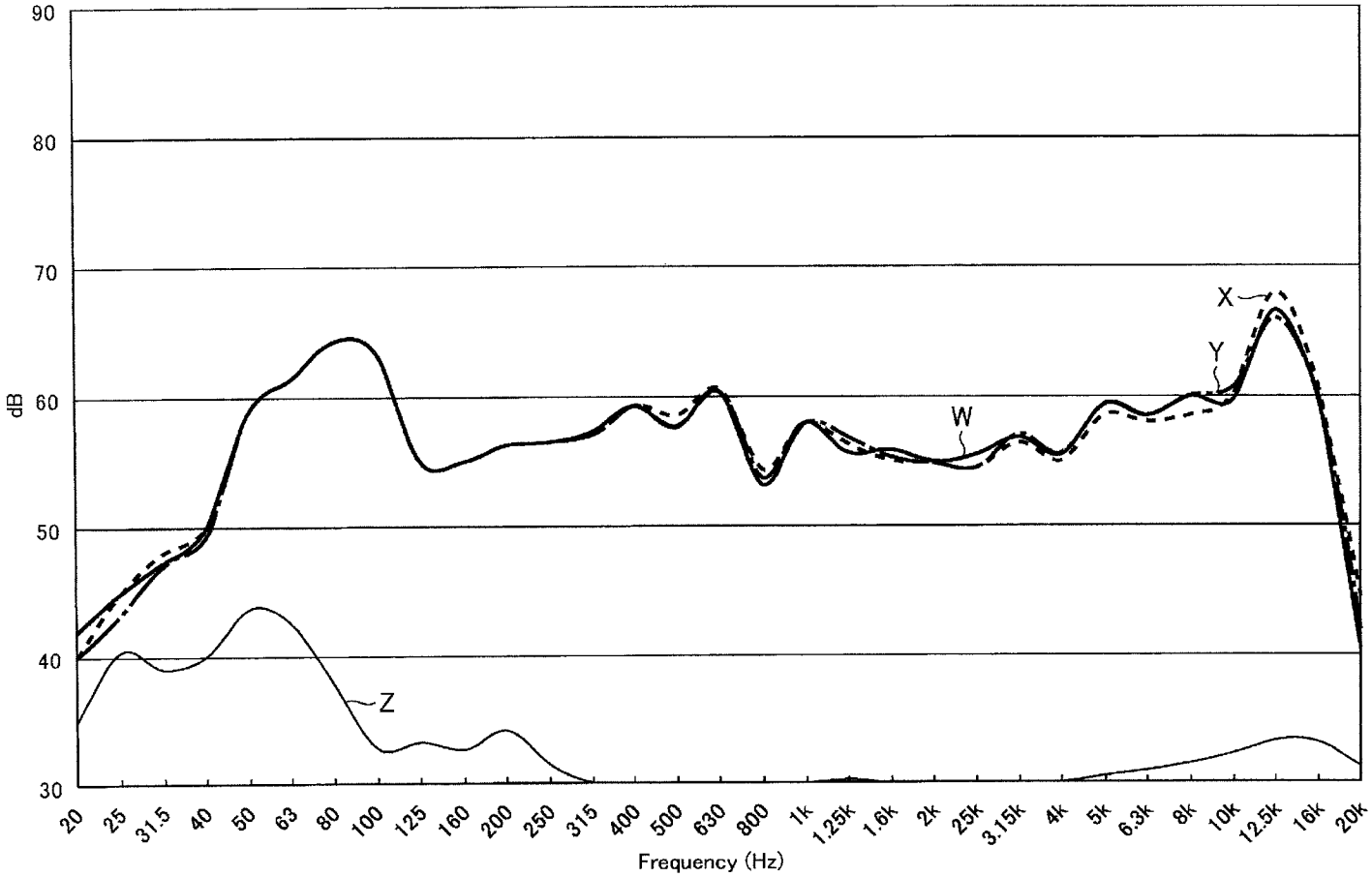
FIG. 5 is a graph showing measurement results of insertion loss in the evaluation test of the microphone device according to one embodiment (first embodiment) of the present invention.

The insertion loss measurement result is shown in FIG. 5. In FIG. 5, reference numeral W is the output characteristics obtained when both the cover member 13 and the acoustic transmission member 24 are provided, reference numeral X is the output characteristics obtained when there are neither the cover member 13 nor the acoustic transmission member 24, reference numeral Y is the output characteristics obtained when there is only the acoustic transmission member 24, and reference numeral Z is the output characteristics of room background noise (measurement environment).

As illustrated, an output waveform in a band frequency of an acoustic component (20 to 20 kHz) is hardly changed when both the cover member 13 and the acoustic transmission member 24 are provided (W), when there are neither the cover member 13 nor the acoustic transmission member 24 (X), and when only the acoustic transmission member 24 is provided (Y). It is, therefore, found that the insertion loss hardly occurs even when both the cover member 13 and the acoustic transmission member 24 are provided, and the acoustic component has good transmissivity (sound quality is not affected).

As described above, according to the microphone device 12 of the present embodiment, wind noise is significantly attenuated by the cover member 13 and the acoustic transmission member 24, collection of wind noise can be suppressed independently of electric signal processing.

In the microphone device 12 shown in FIG. 2, although the microphone housing 21 is separated from the video camera housing 11*a*, the present invention is not limited to such a structure.

Figure 6:
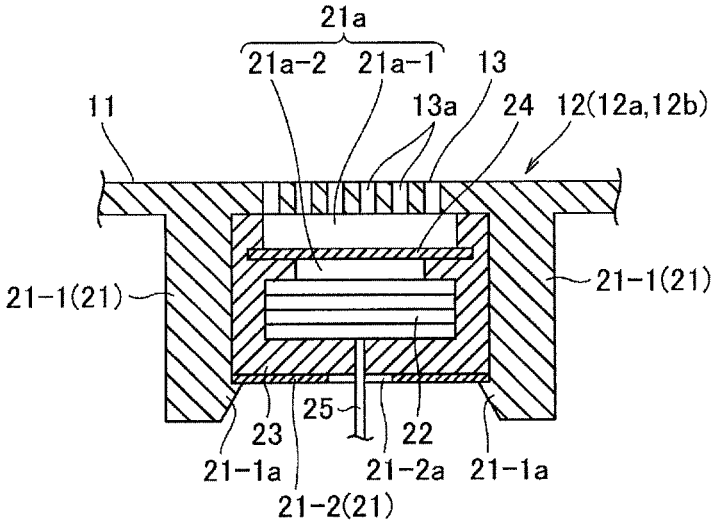
FIG. 6 is a cross-sectional view as a variation of a microphone device built in the video camera of FIG. 1.

For example, as shown in FIG. 6, a peripheral wall portion 21-1 forming a part of the microphone housing 21 is integrally formed with the video camera housing 11*a*, a bottom plate 21-2 forming another part of the microphone housing 21 is anchored to fall prevention claws 21-1*a* formed at a front end of the peripheral wall portion 21-1, and the microphone housing 21 may be constituted of the peripheral wall portion 21-1 and the bottom plate 21-2.

Figure 7:
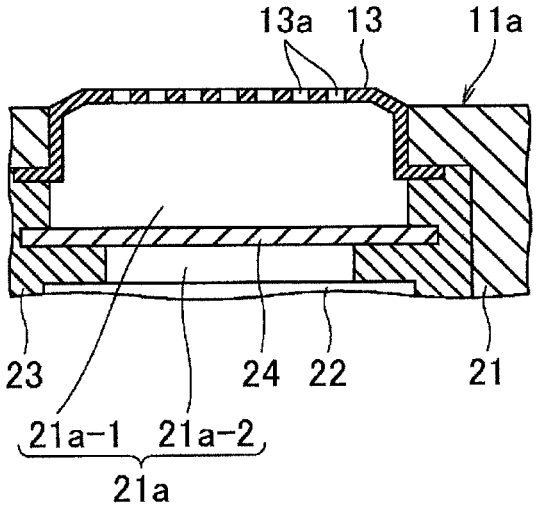
FIG. 7 is a cross-sectional view as another variation of a microphone device built in the video camera of FIG. 1.

In the microphone device 12 shown in FIG. 2, although the elastic member 23 is disposed between the microphone housing 21 and the microphone 22, the elastic member 23 may be disposed between the acoustic transmission member 24 and the microphone 22, as shown in FIG. 6. As shown in FIG. 7, the cover member 13 is provided separately from the video camera housing 11*a*, and the elastic member 23 may be disposed between the cover member 13 and the microphone 22 so that the cover member 13 is held between the elastic member 23 and the microphone housing 21 (or the video camera housing 11*a*).

Namely, the elastic member 23 is disposed at least one of between the microphone housing 21 and the microphone 22, between the cover member 13 and the microphone 22, and between the acoustic transmission member 24 and the microphone 22, whereby vibration transmitted to the microphone 22 may be attenuated (or blocked) through the microphone housing 21, the cover member 13, or the acoustic transmission member 24. However, the elastic member 23 is not essential, and the microphone 22 may be installed directly in the microphone housing 21, for example.

In FIG. 6, the bottom plate 21-2 has a hole 21-2*a*, and wiring 25 extending from the microphone 22 is derived.

Figure 8:
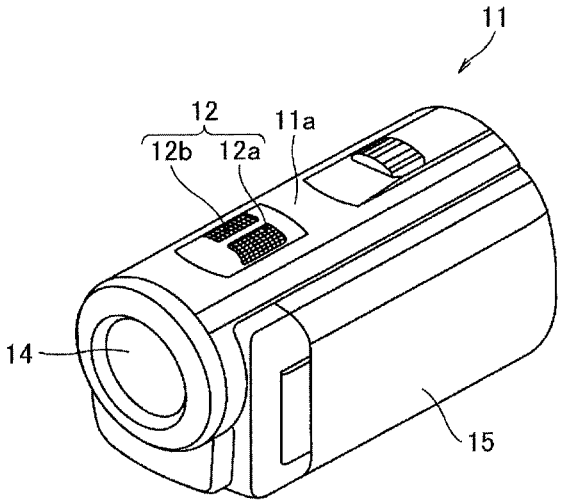

The mounting position of the microphone device 12 is not limited to a lower portion of the front surface of the video camera housing 11*a* shown in FIG. 1, and the microphone device 12 may be disposed on an upper surface of the video camera housing 11*a*, as shown in FIG. 8, for example.

Figure 9:
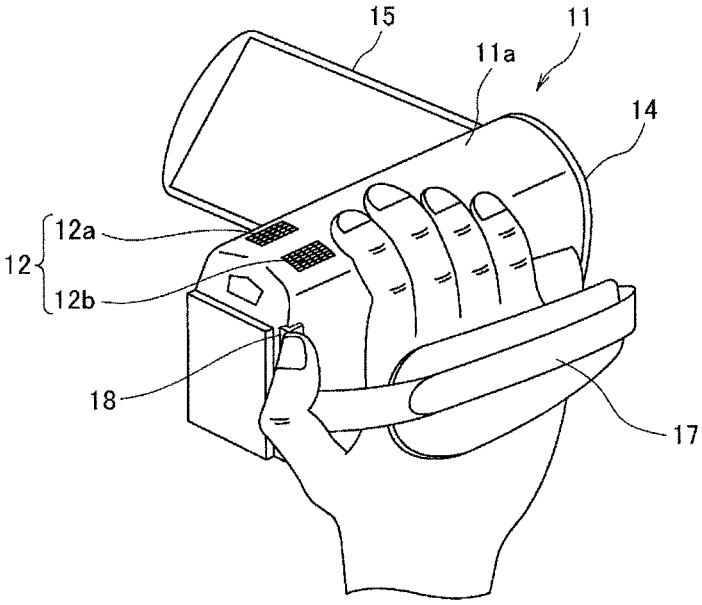

As the video camera 11 which is an imaging device, as shown in FIG. 9 (similarly in FIGS. 1 and 8), there has been widely known a form, in which the video camera housing 11*a* which is a device housing set to a horizontal direction is held with a hand of a photographer while the photographer passes the hand through a grip belt 17, that is, a so-called holding type.

In the holding type of the video camera 11, the microphone device 12 (12*a*, 12*b*) may be disposed on the photographer side relative to a position of a finger holding the video camera housing 11*a* (position of fingers other than a thumb because a recording start/stop button 18 is operated by the thumb), that is, the holding position, as illustrated.

In the above case, the microphone device 12 may not be located on the upper surface of the video camera housing 11*a* shown in FIG. 9, and the microphone device 12 may be located on a surface on the opposite side of the mounting surface of the lens 14 of the video camera housing 11*a*, for example.

Since sound is diffracted, sound can be collected even if the microphone device is disposed on the photographer side relative to the holding position, and, in addition, a photographer himself/herself and the hand holding the video camera 11 serve as a windscreen, so that wind-blown against the microphone device 12 can be reduced.

Hereinabove, although the present invention made by the inventor has been specifically described based on the embodiment, the embodiment disclosed in the present specification is an example in all respects, and it should be considered that the invention is not limited to the disclosed techniques. Namely, the technical scope of the present invention is not interpreted limitedly based on the description in the above embodiment, but should be interpreted in accordance with the scope of the claims, and the technical scope of the invention should include all changes without departing from techniques equivalent to the techniques described in the scope of claims and the gist of the scope of claims.

For example, in the above description, although the microphone device of the present invention is in a form of being built in a video camera as an example of electronics, the microphone device can be grasped as an independent microphone device separated from electronics.

The elastic member is not limited to elastomer composed of a rubber-like elastic body used in the present embodiment as long as it is formed of a material which can attenuate or block vibration transmitted to a microphone.

Second to Sixth Embodiments

Next, other embodiments of the present invention will be described. Microphone units according to the present embodiments are microphone units having at least a first acoustic transmissive material and a second acoustic transmissive material, the first acoustic transmissive material is a fiber material in which fibers are intertwined with each other, the second acoustic transmissive material is a porous member or a mesh-like member having a plurality of holes, and the microphone is configured to be protected by the first acoustic transmissive material and the second acoustic transmissive material in this order.

<<Entire Structure>>

A specific example of a microphone unit (a microphone structure in FIG. 14) according to the present embodiment will be described with reference to FIGS. 10 to 14.

<Example in which Microphone and First Acoustic Transmissive Material are not on the Same Member>

Figure 10:
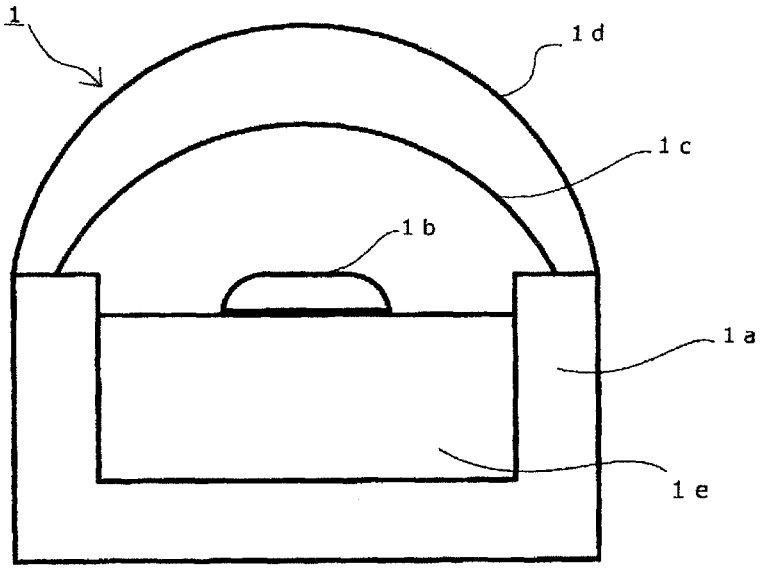
FIG. 10 is a microphone unit according to a second embodiment in which a microphone and a first acoustic transmissive material are not on the same member.

FIG. 10 shows a microphone unit according to the second embodiment. The microphone unit 1 is a fully integrated unit example. The microphone unit 1 has a microphone holder 1*a*, a microphone 1*b* stored in the microphone holder 1*a*, a first acoustic transmissive material 1*c* fixed to the microphone holder 1*a* to cover the microphone 1*b* so as not to be in contact with the microphone 1*b* (in this example, although the first acoustic transmissive material 1*c* is fixed at an upper edge of the microphone holder 1*a*, the invention is not limited thereto), a second acoustic transmissive material 1*d* fixed to the microphone holder 1*a* to cover the first acoustic transmissive material 1*c* so as to be separated from the first acoustic transmissive material 1*c* (in this example, although the second acoustic transmissive material 1*d* is fixed at an upper edge of the microphone holder 1*a*, the invention is not limited thereto), and a microphone cushion 1*e* constituted of an elastic member (for example, silicon rubber) which is a base of the microphone 1*b*. The first acoustic transmissive material 1*d* and the second acoustic transmissive material 1*d* are in a noncontact state in each position. As described above, the first acoustic transmissive material 1*c* is located outside the microphone 1*b* and, at the same time, disposed more inside than the second acoustic transmissive material 1*d*. Since the microphone 1*b*, the first acoustic transmissive material 1*c*, and the second acoustic transmissive material 1*d* are supported by separate bases, even if an external force (such as wind and vibration) is applied to the first acoustic transmissive material 1*c* and the second acoustic transmissive material 1*d*, direct sensing of noise due to the external force can be avoided.

<Example in which Microphone and First Acoustic Transmissive Material are on the Same Member>

Figure 11:
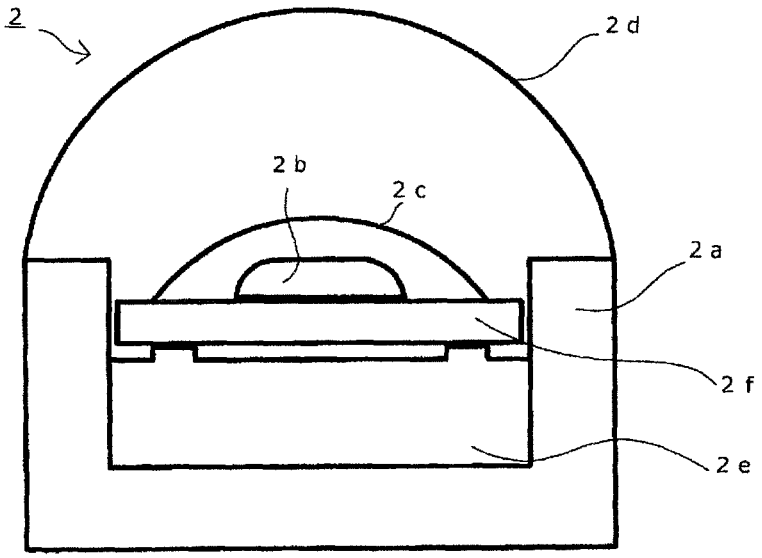
FIG. 11 is a microphone unit according to a third embodiment in which the microphone and the first acoustic transmissive material are on the same member.

Next, FIG. 11 shows a microphone unit according to the third embodiment. A microphone unit 2 is a fully integrated unit example as in the second embodiment. The microphone unit 2 has a microphone holder 2*a*, a microphone 2*b* stored in the microphone holder 2*a*, a first acoustic transmissive material 2*c* fixed to a microphone table 2*f* to cover the microphone 2*b* so as not to be in contact with the microphone 2*b* (in this example, although the first acoustic transmissive material 2*c* is fixed onto an upper surface of the microphone table 2*f*, the invention is not limited thereto), a second acoustic transmissive material 2*d* fixed to the microphone holder 2*a* to cover the first acoustic transmissive material 2*c* so as to be separated from the first acoustic transmissive material 2*c* (in this example, although the second acoustic transmissive material 2*d* is fixed at an upper edge of the microphone holder 2*a*, the present invention is not limited thereto), a microphone cushion 2*e* constituted of an elastic member (for example, silicon rubber) which is a base of the microphone table 2*f*, and the microphone table 2*f* mounting the microphone 2*b* and the first acoustic transmissive material 2*c*. As described above, as in the second embodiment, the first acoustic transmissive material 2*c* is located outside the microphone 2*b* and, at the same time, disposed more inside than the second acoustic transmissive material 2*d*. However, unlike the second embodiment, the microphone 2*b* and the first acoustic transmissive material 2*c* are supported by a common base (microphone table 2*f*). Here, the microphone table 2*f* is configured in a non-contact state with the microphone holder 2*a*. Accordingly, even if the microphone unit 2 is vibrated to some extent, the microphone 2*b* can be effectively prevented from sensing noise due to the vibration unless the microphone holder 2*a* and the microphone table 2*f* are in contact with each other.

<Example in which Microphone and First Acoustic Transmissive Material are on Elastic Member>

Figure 12:
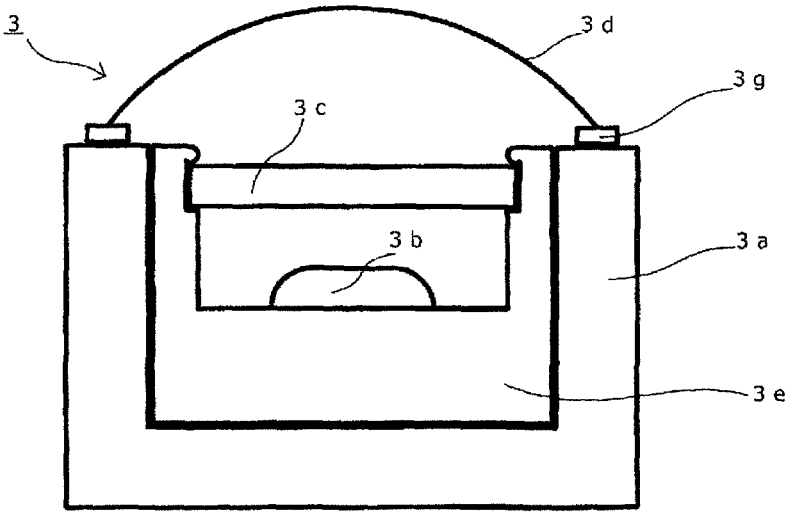
FIG. 12 is a microphone unit according to a fourth embodiment in which the first acoustic transmissive material is installed through an elastic member.

FIG. 12 shows a microphone unit according to the fourth embodiment. A microphone unit 3 is a fully integrated unit example as in the second embodiment. The microphone unit 3 has a microphone holder 3*a*, a microphone 3*b* stored in the microphone holder 3*a*, a first acoustic transmissive material 3*c* fixed to a microphone cushion 3*e* to cover the microphone 3*b* so as not to be in contact with the microphone 3*b*, a second acoustic transmissive material 3*d* fixed to the microphone holder 3*a* through an elastic member 3*g* to cover the first acoustic transmissive material 3*c* so as to be separated from the first acoustic transmissive material 3*c* (in this example, although the second acoustic transmissive material 3*d* is fixed at an upper edge of the microphone holder 3*a*, the invention is not limited thereto), and a microphone cushion 3*e* constituted of an elastic member (for example, silicon rubber) which is a base of the microphone 3*b*. As described above, as in the second and third embodiments, the first acoustic transmissive material 3*c* is located outside the microphone 3*b* and, at the same time, disposed more inside than the second acoustic transmissive material 3*d*. However, unlike the second and third embodiments, the second acoustic transmissive material 3*d* is installed through the elastic member, in addition to the base (microphone cushion 3*e*) common to the microphone 3*b*. According to this constitution, even if an external force (such as wind and vibration) is applied to the second acoustic transmissive material 3*d*, direct sensing of noise due to the external force can be avoided. The elastic member 3*e* and the elastic member 3*g* may be formed of the same material or different materials.

<Example Schematically Showing Installation of Microphone Unit in Electronics>

Figure 13:
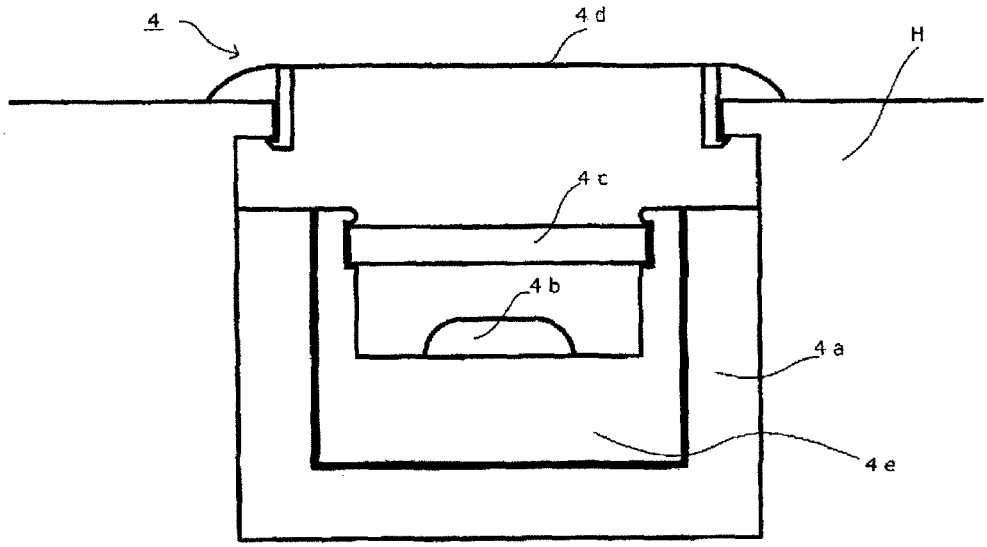
FIG. 13 is a microphone unit according to a fifth embodiment in which the microphone unit of the present invention is applied to electronics.

FIG. 13 shows a microphone unit according to the fifth embodiment. A microphone unit 1 is a unit example in which parts (4*a* to 4*c* and 4*e*) embedded in a void provided in a device body H and a part (4*d*) fitted into an opening of the void of the device body H are physically separated from each other. The equipment body microphone unit 4 has a microphone holder 4*a*, a microphone 4*b* stored in the microphone holder 4*a*, a first acoustic transmissive material 4*c* fixed to the microphone holder 4*a* to cover the microphone 4*b* so as not to be in contact with the microphone 4*b* (in this example, although the first acoustic transmissive material 4*c* is fixed at an upper edge of the microphone holder 4*a*, the invention is not limited thereto), a second acoustic transmissive material 4*d* fixed to the device body H to cover the first acoustic transmissive material 4*c* so as to be separated from the first acoustic transmissive material 4*c* (in this example, although the second acoustic transmissive material 4*d* is configured that ends of the void which is provided in the device body H to store the microphone unit 4 are fixed by claw members, the invention is not limited thereto), and a microphone cushion 4*e* constituted of an elastic member (for example, silicon rubber) which is a base of the microphone 4*b*. As described above, the first acoustic transmissive material 4*c* is located outside the microphone 4*b* and, at the same time, disposed more inside than the second acoustic transmissive material 4*d*. Since the microphone 4*b* and the first and second acoustic transmissive materials 4*c* and 4*d* are supported by separate bases, even if an external force (such as wind and vibration) is applied to the first acoustic transmissive material 4*c* and the second acoustic transmissive material 4*d*, direct sensing of noise due to the external force can be avoided.

<Example in which First Acoustic Transmissive Material is Elastic Member>

Figure 14:
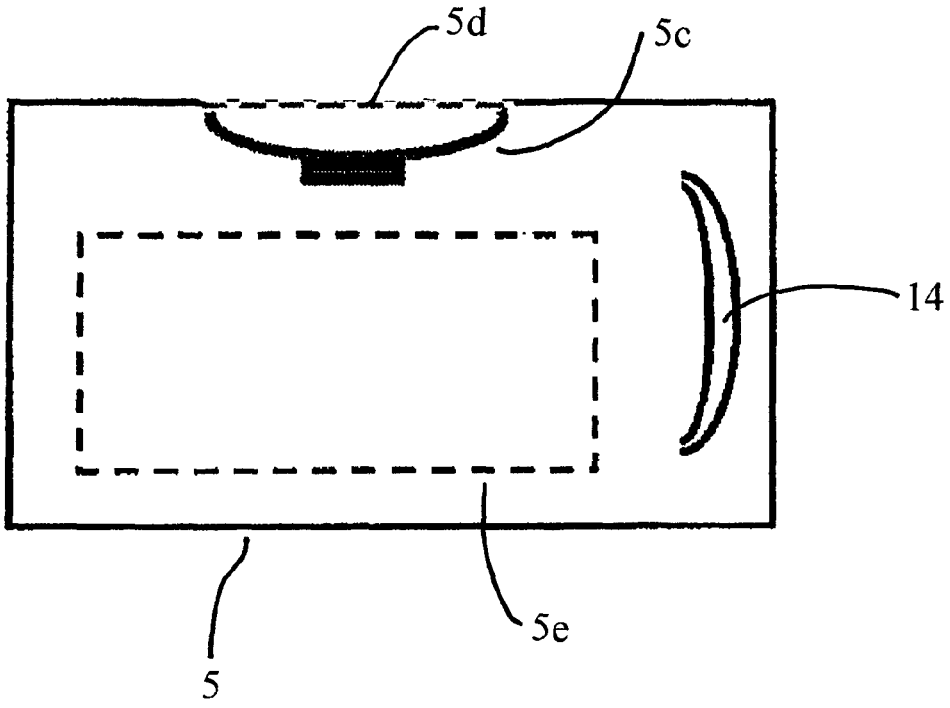
FIG. 14 is a microphone structure according to a sixth embodiment in which a first acoustic transmissive material is used as an elastic member.

FIG. 14 shows a microphone structure according to a sixth embodiment. Unlike the other embodiments, this embodiment is not a unit (although the other embodiments are preferably units, they may not be units) but a microphone structure (upper portion of FIG. 14). As shown in FIG. 14, the microphone structure is constituted of a second acoustic transmissive material 5*d* (dotted line in FIG. 14) attached to an upper surface of a housing, a first acoustic transmissive material 5*c* (semi-elliptical solid line in FIG. 14) attached to an interior back surface of the housing, and a microphone 5 (rectangular solid line in FIG. 14) attached to a back surface of the first acoustic transmissive material. A semi-elliptical double line on the right side of FIG. 14 shows a lens 14, and a rectangular dotted line at the center of the housing shows an internal structure (including an electronic component) 5*e*. In the mounting of the microphone to the first acoustic transmissive material, the microphone is mounted to the first acoustic transmissive material so that a sound collecting side of the microphone is the back surface side of the first acoustic transmissive material. According to this constitution, sound from outside is guided to the second acoustic transmissive material, the first acoustic transmissive material, and the microphone in this order. Consequently, the wind whistling sound can be prevented as in the other embodiments, and, in addition to this, the first acoustic transmissive material functions as an elastic member, so that the microphone can be effectively prevented from sensing noise due to vibration and so on, as in the other embodiments.

Although the microphone units according to FIGS. 10 to 14 (a microphone structure in FIG. 14) are examples in which there are only the first acoustic transmissive material and the second acoustic transmissive material as the acoustic transmissive materials, one or a plurality of acoustic transmissive materials may be further provided (between the first acoustic transmissive material and the second acoustic transmissive material or outside the second acoustic transmissive material, for example). For example, a plurality of acoustic transmissive materials corresponding to the second acoustic transmissive material may be used. When the plurality of acoustic transmissive materials are used, it is preferable that the second acoustic transmissive materials are spaced apart from each other and arranged so that impedance becomes larger in descending order of distance from the first acoustic transmissive material, and namely it is preferable that the second acoustic transmissive materials are arranged in the order from the second acoustic transmissive material having a rougher mesh to the second acoustic transmissive material having a finer mesh. However, when a plurality of the second acoustic transmissive materials are used, since the number of air layers between the second acoustic transmissive materials increases, a significant reduction in the acoustic transmissivity in a low-pitched sound range possibly caused by resonance in the air layer is seen, so that a relationship with a sound range requiring sound collection is required to be considered. Next, each member constituting the microphone unit according to the present embodiment will be described sequentially.

<<First Acoustic Transmissive Material>>

The first acoustic transmissive material used in the present embodiment is a fiber member (preferably a nonwoven sheet) formed by intertwining fibers with each other. Hereinafter, the material, structure, property, and producing method will be described sequentially.

<Material>

Examples of fiber (base fiber) used in the first acoustic transmissive material include metal fiber, resin fiber, and composite fiber thereof. Particularly, by virtue of the use of the metal fiber, a self-standing property is easily secured. In addition to those base fibers, other components (such as a material having a self-adhesive function, although they will be described in the producing method) may be contained.

Although the metal fiber is not particularly limited, the fiber can be a kind selected from fibers using, as a material, a metal material such as stainless steel, aluminum, brass, copper, titanium, nickel, gold, platinum, and lead, or a combination of two or more kinds thereof.

As the resin fiber, fluorine fiber is preferred. It is preferable to select the fluorine fiber from thermoplastic fluororesins, such as polytetrafluoroethylene (PTFE), tetrafluoroethylene (TFE), perfluoroether (PFE), a copolymer of tetrafluoroethylene and hexafluoropropylene (FEP), a copolymer of tetrafluoroethylene and ethylene or propylene (ETFE), a polyvinylidene fluoride resin (PVDF), a polychlorotrifluoroethylene resin (PCTFE), and polyvinyl fluoride resin (PVF).

<Structure>

The thickness of the first acoustic transmissive material is preferably not more than 3 mm, more preferably 50 μm to 2000 μm, still more preferably 100 μm to 1500 μm, and particularly preferably 500 μm to 1000 μm. When the material having the above porosity has the thickness within the relevant range, a material having high acoustic transmissivity is obtained.

The shape of the first acoustic transmissive material is not particularly limited and may be a flat shape (the first acoustic transmissive material 3*c* in FIG. 12 and the first acoustic transmissive material 4*c* in FIG. 13), a hemispherical shape, or a dome shape (the first acoustic transmissive material 1*c* in FIG. 10 and the first acoustic transmissive material 2*c* in FIG. 11).

Although the diameter of fiber used in the first acoustic transmissive material is not particularly limited, it is preferably 1 to 50 μm, more preferably 1 to 40 μm, and still more preferably 2 to 30 μm, for example. The fiber diameter is included in such a range, whereby the strength of the fiber can be increased, and at the same time, appropriate sound transmissivity is easily obtained.

<Property>

The Taber stiffness of the first acoustic transmissive material used in the present embodiment is not less than 5 mN·m, preferably not less than 8 mN·m, and more preferably not less than 10 mN·m. Although the upper limit of the Taber stiffness is not particularly limited, it is 100 mN·m, for example. When the acoustic transmissive material has the Taber stiffness within the relevant range, a material having the self-standing property is obtained. The Taber stiffness is measured in accordance with JIS-P8125. The value of the Taber stiffness can be adjusted by the hardness of fiber in use, the density of the first acoustic transmissive material, and the pressure in compression molding, based on the knowledge of those skilled in the art.

The bending resistance of the first acoustic transmissive material used in the present embodiment is not less than 100 mN, preferably not less than 150 mN, and more preferably not less than 200 mN. Although the upper limit of the bending resistance is not particularly limited, it is 2000 mN, for example. When the first acoustic transmissive material has the bending resistance within the relevant range, a material having self-standing property is obtained. The value of the bending resistance is obtained by measurement in accordance with the Taber stiffness test according to JIS-P8125. The value of the bending resistance can be adjusted by the hardness of fiber in use, the density of the first acoustic transmissive material, and the pressure in compression molding, based on the knowledge of those skilled in the art.

The porosity of the first acoustic transmissive material used in the present embodiment is not less than 50%, preferably 60 to 90%, and more preferably 70 to 90%. Although the upper limit of the porosity is not limited particularly, it is 95%, for example. In the material formed by intertwining fibers, when a material whose porosity is included within the relevant range is selected, such an effect that the acoustic transmissivity is secured while having the self-standing property is provided.

Considering angular dependency of acoustic transmission, it is particularly preferable that the porosity of the first acoustic transmissive material is 80 to 90%. When the porosity is included in such a range, high acoustic transmissivity that hardly depends on an incident angle of sound to a material can be exercised.

The porosity is calculated from the volume and the weight of the first acoustic transmissive material and the specific gravity of a fiber material at a rate of a space, in which fiber is not present with respect to the volume of the first acoustic transmissive material.

$$\text{Porosity (\%)}=(1-\text{weight of acoustic transmissive material}/(\text{volume of acoustic transmissive material}\times\text{specific gravity of fiber}))\times 100$$

The value of the porosity can be adjusted by the thickness and amount of fiber in use, the density of the material in which fibers are intertwined with each other, and the pressure in compression molding, based on the knowledge of those skilled in the art.

In the first acoustic transmissive material used in the present embodiment, the insertion loss is preferably not more than 5 dB in each 1/1 octave bands of 63 Hz to 8 kHz, more preferably not more than 3 dB.

<Producing Method>

The first acoustic transmissive material is obtained by a method of compression molding fiber or by papermaking a raw material, configured to contain fiber, by a wet papermaking method.

When the first acoustic transmissive material of the present embodiment is produced by the compression molding, using metal fiber or resin fiber (for example, fluorine fiber), the fibers are first bundled to be preliminarily compressed, and, thus, to form a web. Alternatively, a binder may be impregnated between fibers to add a binding between the fibers. Although such a binder is not particularly limited, in addition to an organic binder such as an acrylic-based adhesive, an epoxide-based adhesive, and a urethane-based adhesive, an inorganic adhesive such as colloidal silica, liquid glass, and silicate soda may be used for example. Instead of impregnation with the binder, a fiber surface is previously coated with a heat adhesive resin, and an aggregation of metal fibers may be stacked, and then heated and adhered. The amount of impregnation of the binder is preferably 5 to 130 g with respect to a sheet surface weight of 1000 g/m$^2$, and more preferably 20 to 70 g.

The aggregation of the metal fibers is pressurized while being heated, whereby a sheet is formed. Although the heating conditions are set considering the drying temperatures and curing temperatures of the binder in use and the heat adhesive resin, the heating temperature is usually approximately 50 to 1000° C. The pressure to be added is adjusted considering the elasticity of fiber, the thickness of the first acoustic transmissive material, and the light transmittance of the first acoustic transmissive material. When the fiber is impregnated with the binder by spraying, it is preferable that a metal fiber layer is formed to have a predetermined thickness by press working and so on before the spray treatment.

In the first acoustic transmissive material using metal fiber, a sheet of slurry containing the metal fiber can be formed by a wet papermaking method. When the slurry containing the metal fiber is produced, the dispersibility of the metal fiber in water may be deteriorated, and therefore, a small amount of a polymer aqueous solution having a thickening effect, such as polyvinylpyrrolidone, polyvinyl alcohol, and carboxymethyl cellulose (CMC), may be added. As the papermaking method, various methods including, for example, fourdrinier papermaking, cylinder mold papermaking, and inclined wire type papermaking can be employed as necessary.

When the wet papermaking method is used, it is preferable to produce the first acoustic transmissive material through a fiber intertwining treatment process of intertwining the metal fibers, constituting a moisture-containing sheet on a net, with each other. As the fiber intertwining treatment process, it is preferable to employ, for example, a fiber intertwining treatment process of jetting a high-pressure water jet against a metal fiber sheet surface after the papermaking. More specifically, a plurality of nozzles are arranged in a direction perpendicular to a sheet flow direction, and the high-pressure water jets are simultaneously jetted from the nozzles, whereby the metal fibers can be intertwined with each other throughout the sheet.

It is preferable that a method for producing a metal fiber material includes, after the wet papermaking process described above, a sintering process of sintering the obtained metal fiber material in vacuum or in a non-oxidative atmosphere at a temperature not more than the melting point of the metal fiber. Since the metal fibers are intertwined with each other, the strength of the sintered metal fiber material can be enhanced. By virtue of the sintering of the metal fiber material, the metal fiber material exhibiting high acoustic transmissivity and highly resistant to water (not less than JIS IPX2) is obtained. When the metal fiber material is not sintered, remaining macromolecules having a thickening effect absorb water, so that resistance to water may be deteriorated.

In the method for producing an acoustic transmissive material by using fluorine fiber, the fluorine fiber and a material having a self-adhesive function are mixed by the wet papermaking method and dried to obtain a fluorine fiber mixed paper material. The obtained fluorine fiber mixed paper material is thermally compressed at a temperature of not less than a softening point of the fluorine fiber to heat seal between fibers of the fluorine fiber. Thereafter, the material having a self-adhesive function is dissolved and removed by a solvent and dried again if necessary, whereby the acoustic transmissive material can be produced. As the material having a self-adhesive function, there may be used natural pulp made from plant fiber such as wood, cotton, hemp, and straw usually used in the manufacture of paper, synthetic pulp and synthetic fiber made from polyvinyl alcohol (PVA), polyester, aromatic polyamide, and acrylic or polyolefin thermoplastic synthetic polymer, and a paper strengthening agent for papermaking made from natural polymer or synthetic polymer. The material is not limited to them as long as it has a self-adhesive function, is mixed with fluorine fiber, and can be dispersed in water.

<<Second Acoustic Transmissive Material>>

The second acoustic transmissive material used in the present embodiment is installed on the opposite side of the microphone holder of the first acoustic transmissive material while being spaced apart from the first acoustic transmissive material. When the second acoustic transmissive material is installed on a front surface of the first acoustic transmissive material, wind noise is reduced compared with the first acoustic transmissive material alone. Although the details of this mechanism are unclear, it is supposed that by virtue of the installation of the second acoustic transmissive material, resonance sound considered to be generated when wind directly hits against the first acoustic transmissive material is suppressed, and generation of wind noise attributable to the fact that the second acoustic transmissive material suppresses generation of turbulence is reduced. Hereinafter, the material and the structure will be described sequentially.

<Material>

Although a material used in the second acoustic transmissive material is not particularly limited, it is preferable to use a plastic material such as nylon, polypropylene, polycarbonate, and ABS (acrylonitrile-butadiene-styrene copolymer) resin, for example, and a metal material such as iron, aluminum, and stainless steel, for example.

<Structure>

The second acoustic transmissive material may prevent an air flow such as wind, which is a noise source from directly colliding against a surface of the first acoustic transmissive material and may not be finely woven to such an extent that the first acoustic transmissive material installed on the back of the second acoustic transmissive material cannot be visually confirmed through the second acoustic transmissive material.

Thus, in a first preferred embodiment of the second acoustic transmissive material, it is preferable to provide a plurality of holes for making impedance smaller than that of the first acoustic transmissive material, and considering processing of the second acoustic transmissive material and installation in AV/IT equipment, in a mesh-shaped second acoustic transmissive material, the size of the mesh is preferably 5 to 100 mesh, more preferably 10 to 20 mesh, or the hole diameter is preferably 0.1 to 3.0 mmΦ, more preferably 0.5 to 2.0 mmΦ. Sizes of holes may be wholly the same or different. In a second preferred embodiment of the second acoustic transmissive material, a total value of a hole area (opening ratio) with respect to a total area is preferably not less than 15%, more preferably not less than 25%, still more preferably not less than 50%. Although the upper limit of the opening ratio is not particularly specified, since the shape of the second acoustic transmissive material is required to be minimally held, it is not more than 95%. The shape of the hole is not limited and may be a circle, a square, or an infinite form. When the shape of the hole is not a circle, the hole diameter is a diameter of a circle having an area the same as the area of the relevant hole (area of the opening portion).

The shape of the second acoustic transmissive material is not particularly limited and may be a flat shape (the second acoustic transmissive material 4*d* in FIG. 13), a hemispherical shape, or a dome shape (the second acoustic transmissive material 1*d* in FIG. 10, the second acoustic transmissive material 2*d* in FIG. 11, and the second acoustic transmissive material 3*d* in FIG. 12).

In the installation of the second acoustic transmissive material, an elastic member may be provided between the second acoustic transmissive material and the microphone holder or the AV/IT equipment. By virtue of the provision of the elastic member, vibration generated in the second acoustic transmissive material can be absorbed, and wind noise can be further reduced.

<<Microphone Holder>>

The microphone holder used in this embodiment has a function of fixing a microphone and, in addition, a function of shielding resonance sound, vibration sound, and internal operation sound and vibration sound of the installed AV/IT equipment. In order to prevent the resonance sound, the operation sound, and the vibration sound, a constitution in which the microphone holder is provided with an elastic member, and a microphone is provided on this cushion member is preferred.

As the elastic member, a material generally used in the AV/IT equipment may be used unless the resonance sound, the operation sound, and the vibration sound are transmitted to a microphone. For example, a rubber-like member such as urethane rubber, natural rubber, and silicone rubber is preferably used. The first acoustic transmissive material also functions as the elastic member.

<<Operation>>

Figure 15:
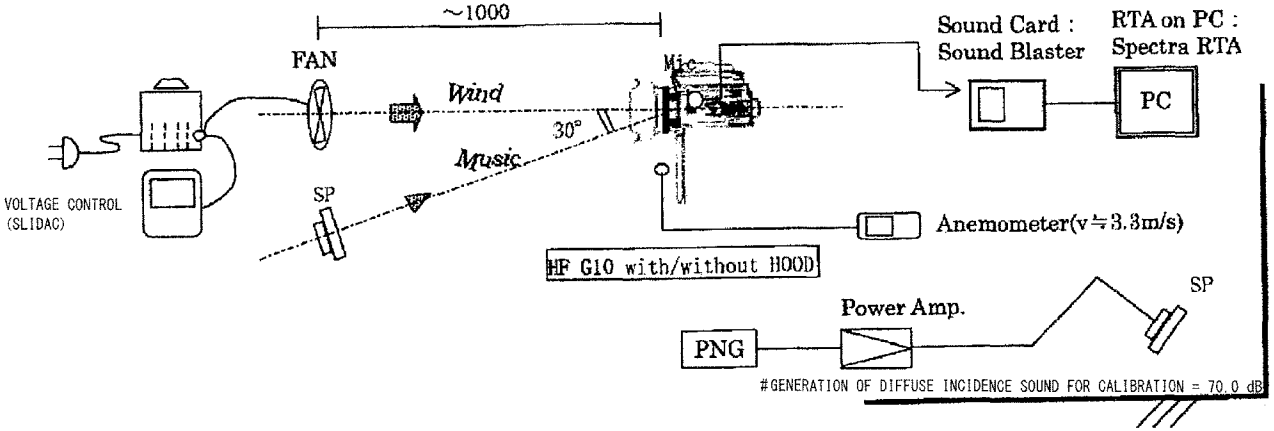
FIG. 15 is a schematic diagram of a measurement evaluation system used in verification of wind whistling sound reduction effect evaluation.

In the microphone unit of the present embodiment, in a wind whistling sound reduction effect evaluation method, it is preferable that the wind whistling sound reduction effect of not less than Δ20 dBA in 500 Hz is provided with respect to wind having a wind speed of 2.7 m. In a wind whistling sound reduction effect evaluation test, wind with a wind speed of 2.7 m/s (in a range in which generation of wind whistling sound is confirmed and reduction of the wind whistling sound can be observed) is sent from a blower or the like in an anechoic room. When the response measured in such a state that the relevant member is mounted is reduced by S (dBA) at a noise level (dBA) relative to a microphone output response observed without both the first acoustic transmissive material and the second acoustic transmissive material, the case is referred to as a wind whistling sound reduction effect ΔS (dBA). FIG. 15 is a schematic diagram of a measurement evaluation system used in verification of the wind whistling sound reduction effect evaluation.

In the following examples, the following first acoustic transmissive materials were used.

(First Acoustic Transmissive Material A)

Fiber having a wire diameter of 30 μm of stainless steel AISI316L was used, and the fibers were uniformly superposed to form a cotton-like web. The web was weighed so that the weight was 950 g/m$^2$ and compressed between flat plates so that the thickness was 800 μm. The web having a plate shape by compression was put into a sintering furnace to be heated to 1100° C. in a vacuum atmosphere, and, thus, to be sintered, whereby a sample was obtained. The Taber stiffness of the obtained sample was 33.0 mN·m, the bending resistance was 683 mN, the porosity was 84.8%, and the insertion loss was not more than 3 dB in each 1/1 octave bands of 63 Hz to 8 kHz.

(First Acoustic Transmissive Material B)

Aluminum fiber having a wire diameter of 30 μm was used, a web was formed in the same manner as in Example 1. The web was weighed so that the weight was 800 g/m$^2$ and compressed between flat plates so that the thickness was 1000 μm. The web having a plate shape by compression was put into a sintering furnace to be heated to 800° C. in a hydrogen atmosphere, and, thus, to be sintered, whereby a sample was obtained. The Taber stiffness of the obtained sample was 11.9 mN·m, the bending resistance was 245 mN, the porosity was 70.5%, and the insertion loss was not more than 5 dB in each 1/1 octave bands of 63 Hz to 8 kHz.

(First Acoustic Transmissive Material C)

A stainless steel fiber sheet "Tomy Filec SS" SS8-50M (produced by Tomoegawa Paper Co., Ltd.) was used as a sample. The Taber stiffness of the sample was 0.31 mN·m, the bending resistance was 6.31 mN, the porosity was 86.5%, and the insertion loss was not more than 3 dB in each 1/1 octave bands of 63 Hz to 8 kHz.

(First Acoustic Transmissive Material D)

A fluorine fiber sheet "Tomy Filec F" R-250 (produced by Tomoegawa Paper Co., Ltd.) was used as a sample. The Taber stiffness of the sample was 0.23 mN·m, the bending resistance was 4.76 mN, the porosity was 70.3%, and the insertion loss was not more than 3 dB in each 1/1 octave bands of 63 Hz to 8 kHz.

Examples 1 and 2

A microphone unit having a configuration shown in FIG. 10 was produced. As the second acoustic transmissive material, a nylon mesh (hole diameter: 1.4 mm square size, opening ratio: 70%) was used. A microphone unit using the first acoustic transmissive material A is Example 1, and a microphone unit using the first acoustic transmissive material B is Example 2.

Examples 3 to 6

A microphone unit having a configuration shown in FIG. 12 was produced. As the second acoustic transmissive material, a nylon mesh (hole diameter: 1.4 mm square size, opening ratio: 70%) was used. Microphone units using the first acoustic transmissive materials A, B, C, and D are Examples 3, 4, 5, and 6, respectively.

Examples 7 to 10

A microphone unit having a configuration shown in FIG. 13 was produced. As the second acoustic transmissive material, an ABS material having punch holes (hole diameter: 0.5 mm, opening ratio: 27%) was used. Microphone units using the first acoustic transmissive materials A, B, C, and D are Examples 7, 8, 9, and 10, respectively.

Figure 16:
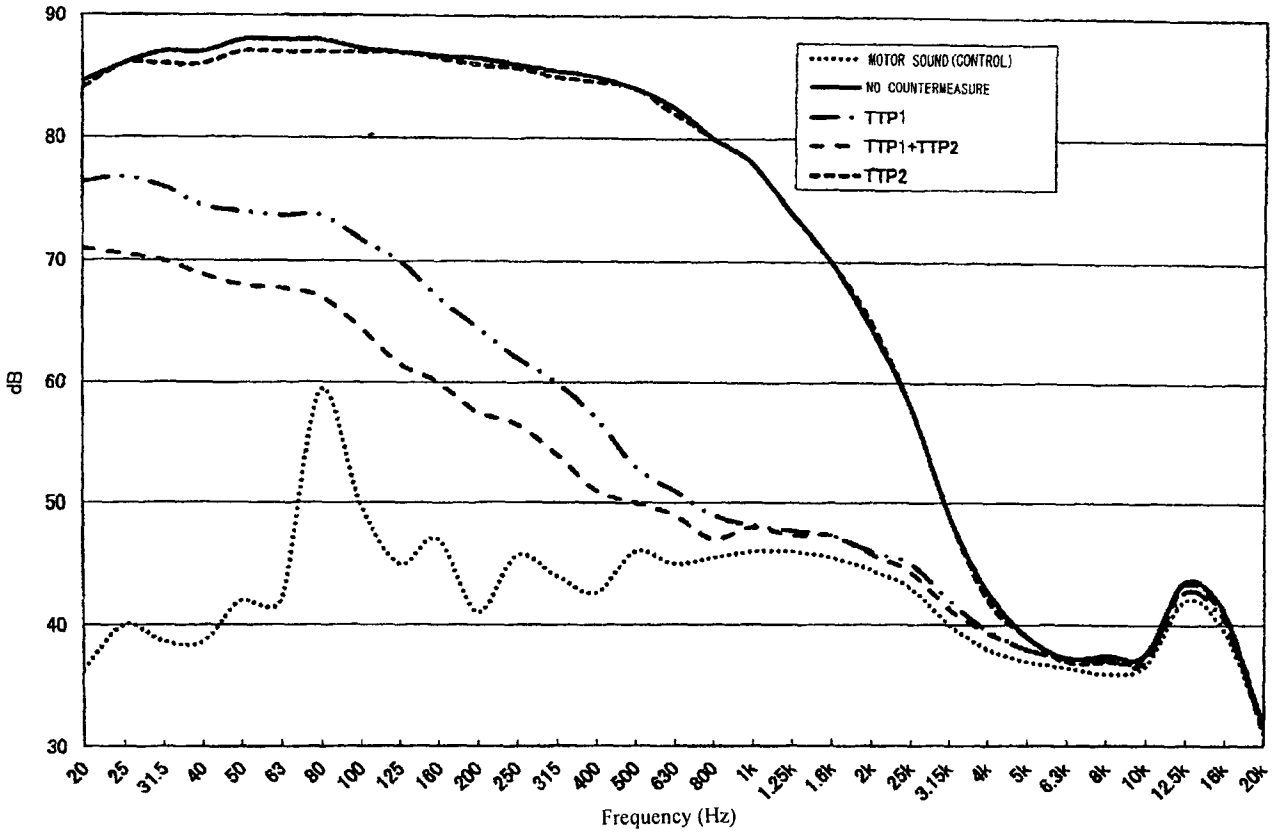
FIG. 16 is wind whistling sound reduction effect evaluation data in the fourth embodiment.
Figure 17:
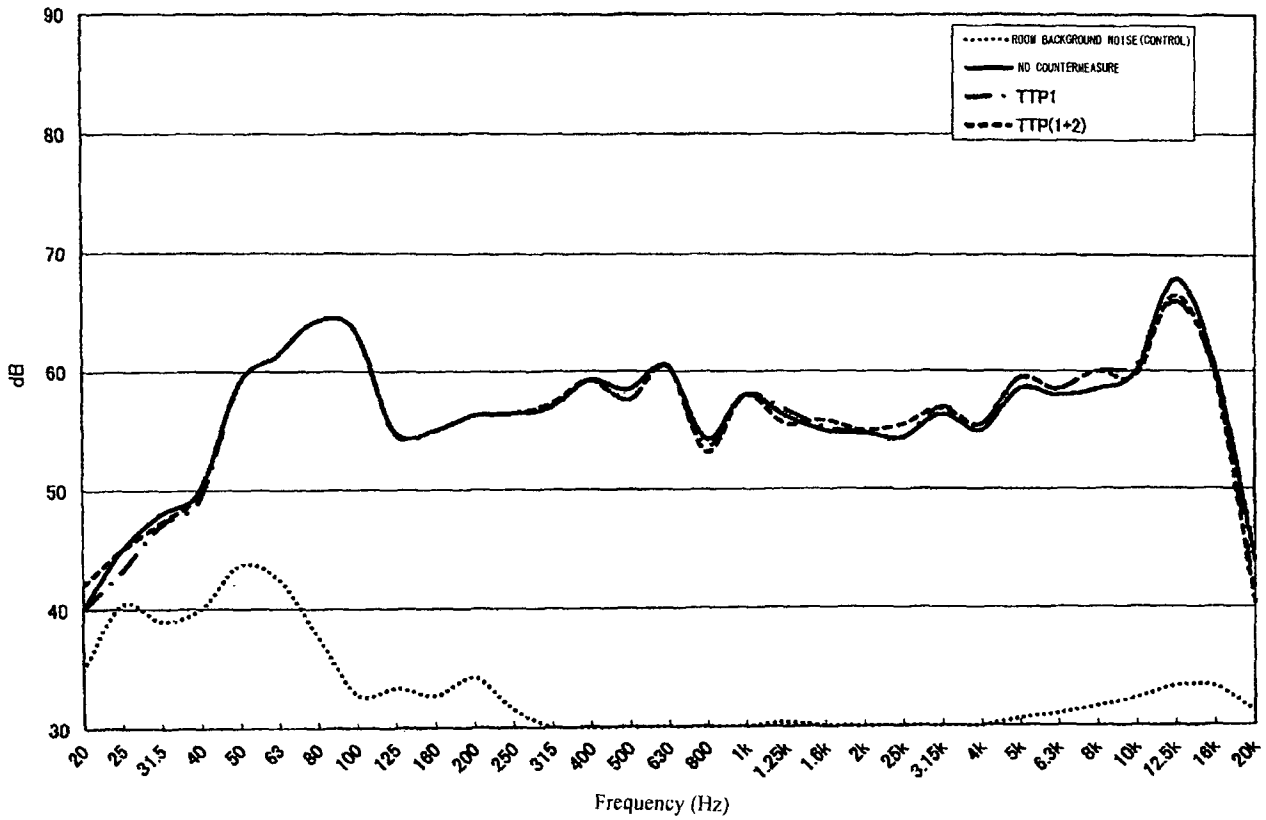
FIG. 17 is a graph in which a relation between frequency and insertion loss in each acoustic transmissive material according to the fourth embodiment is measured.

The microphone units according to Examples 1 to 10 were mounted to a digital video, a measurement evaluation system according to FIG. 15 was used, and the wind whistling sound reduction effect evaluation was verified. Consequently, in each example, the following results were obtained. Namely, (1) there was little to no difference in the effect between the case where no acoustic transmissive material was mounted and the case where only the second acoustic transmissive material was mounted, (2) a substantial wind whistling sound reduction effect could be confirmed when only the first acoustic transmissive material was mounted, (3) a further wind whistling sound reduction effect could be confirmed when the first acoustic transmissive material and the second acoustic transmissive material were mounted, (4) when the mounting positions of the first acoustic transmissive material and the second acoustic transmissive material were reversed, the effect similar to that in the case of mounting only the first acoustic transmissive material could be confirmed, and (5) it could be confirmed that in the first acoustic transmissive material, the insertion loss was not more than 5 dB in each 1/1 octave bands of 63 Hz to 8 kHz, and namely, the sound quality and the sound volume were hardly affected (measurement under such a condition that wind was not generated). In other examples, substantially the same results were obtained. FIG. 16 is wind whistling sound reduction effect evaluation data in Example 3. In FIG. 16, "motor sound" is background noise, that is, noise (CONTROL) that is not wind whistling sound and is generated by a motor or blades themselves of a blower. "No countermeasure" is an embodiment in which neither the first acoustic transmissive material nor the second acoustic transmissive material are mounted (a difference from the CONTROL is an increased amount derived from wind whistling sound). "TTP1" is an embodiment in which only the first acoustic transmissive material is mounted. "TTP2" is an embodiment in which only the second acoustic transmissive material is mounted. "TTP1+TTP2" is an embodiment in which both the first acoustic transmissive material and the second acoustic transmissive material are mounted so that the second acoustic transmissive material is provided outside the first acoustic transmissive material. The horizontal axis represents frequency (Hz), and the vertical axis represents dB. FIG. 17 is a graph in which a relation between frequency and insertion loss in each acoustic transmissive material according to Example 3 is measured. "Room background noise" is background noise, that is, sound generated in a room in such a state that there is no audio output of a speaker (SP). "No countermeasure" is an embodiment in which neither the first acoustic transmissive material nor the second acoustic transmissive material are mounted (a difference from the CONTROL corresponds to an input of sound from a speaker). "TTP1" is an embodiment in which only the first acoustic transmissive material is mounted. "TTP1+TTP2" is an embodiment in which both the first acoustic transmissive material and the second acoustic transmissive material are mounted so that the second acoustic transmissive material is provided outside the first acoustic transmissive material.

Although the above description shows the case where the microphone device of the present invention is applied to a video camera as an imaging device which is an example of electronics, the electronics of the present invention is not limited to the video camera and is applicable to various electronics having a sound collection function, such as a cell phone and a camera.

The invention claimed is:

1. A microphone device comprising:

a housing having a microphone installation chamber opening outward;

a microphone stored in the microphone installation chamber;

a cover member having a plurality of through holes and covering the microphone installation chamber; and an acoustic transmission member partitioning the microphone installation chamber into a first space on the cover member side and a second space on the microphone side and, at the same time, transmitting an acoustic component, wherein the acoustic transmission member includes a fiber material obtained by intertwining raw materials, configured to contain fiber, with each other and air permeability of the fiber material is less than 0.5 s/100 $cm^3$, and wherein the fiber material is sintered or is bonded together by thermal fusion bonding.

2. The microphone device according to claim 1, wherein the fiber is metal fiber or fluorine fiber.

3. The microphone device according to claim 1, further comprising an elastic member disposed at least one of between the housing and the microphone, between the cover member and the microphone, and between the acoustic transmission member and the microphone and attenuating or blocking vibration transmitted to the microphone through the housing, the cover member, or the acoustic transmission member.

4. Electronics mounted with the microphone device according to any one of claims 1 to 3.

5. The electronics according to claim 4 being an imaging device in a form in which a photographer holds a device housing set to a horizontal direction with one hand, and the microphone device being disposed on the photographer side relative to a holding position of the device housing.

6. The microphone device according to claim 1, wherein the cover member comprises a mesh of size 5 to 100 mesh and hole diameter of the mesh is 0.1 to 3.0 mm.

7. The microphone device according to claim 1, wherein the cover member has lower impedance than the acoustic transmission member.

8. A microphone structure comprising:

a microphone;

a cover member having a plurality of through holes; and an acoustic transmission member interposed between the cover member and the microphone and transmitting an acoustic component, wherein the acoustic transmission member includes a fiber material obtained by intertwining raw materials, configured to contain fiber, with each other, and air permeability of the fiber material is less than 0.5 s/100 $cm^3$, and wherein the fiber material is sintered or is bonded together by thermal fusion bonding.

9. The microphone structure according to claim 8, wherein the fiber is metal fiber or fluorine fiber.

10. The microphone structure according to claim 8, further comprising an elastic member disposed at least one of between the cover member and the microphone and between the acoustic transmission member and the microphone and attenuating or blocking vibration transmitted to the microphone through the cover member or the acoustic transmission member.

11. The microphone structure according to claim 8, wherein the microphone is mounted to the acoustic transmission member.

12. Electronics mounted with the microphone structure according to any one of claims 8 to 11.

13. The electronics according to claim 12 being an imaging device in a form in which a photographer holds a device housing set to a horizontal direction with one hand, wherein the microphone structure is disposed on the photographer side relative to a holding position of the device housing.

14. The microphone structure according to claim 8, wherein the cover member comprises a mesh of size 5 to 100 mesh and hole diameter of the mesh is 0.1 to 3.0 mm.

15. The microphone structure according to claim 8, wherein the cover member has lower impedance than the acoustic transmission member.

16. A microphone structure comprising at least a microphone, a first acoustic transmissive material, and a second acoustic transmissive material, wherein the first acoustic transmissive material is a fiber material in which fibers are intertwined with each other, the second acoustic transmissive material is a mesh-like member or a porous member including a plurality of holes, the microphone is protected from incoming noise first by the second acoustic transmissive material and then by the first acoustic transmissive material, and air permeability of the fiber material is less than 0.5 s/100 $cm^3$, wherein the fiber material is sintered or is bonded together by thermal fusion bonding.

17. The microphone structure according to claim 16 having a wind whistling sound reduction effect of not less than Δ20 dBA with respect to wind having a wind speed of 2.7 m/s.

18. The microphone structure according to claim 16, wherein the first acoustic transmissive material is installed through an elastic member.

19. The microphone structure according to claim 16, wherein the microphone is mounted to the first acoustic transmissive material.

20. The microphone structure according to claim 16, wherein the fiber is metal fiber or resin fiber having a fiber diameter of 1 to 50 μm.

21. The microphone structure according to claim 16, wherein in the first acoustic transmissive material, Taber stiffness is not less than 5 mN·m, bending resistance is not less than 100 mN, porosity is not less than 50%, and thickness is not more than 3 mm.

22. The microphone structure according to claim 16, wherein the microphone is installed on a microphone cushion formed of an elastic member, and the first acoustic transmissive material and the second acoustic transmissive material are not fixed onto the microphone cushion.

23. The microphone structure according to any one of claims 16 to 22, wherein insertion loss is not more than 5 dB in each 1/1 octave bands of 63 Hz to 8 kHz.

24. The microphone structure according to claim 16, wherein the second acoustic transmissive material comprises a mesh of size 5 to 100 mesh and hole diameter of the mesh is 0.1 to 3.0 mm.

25. The microphone structure according to claim 16, wherein the second transmissive material has lower impedance than the first transmissive material.

* * * * *